US009086242B2

(12) United States Patent
Newman, Jr.

(10) Patent No.: US 9,086,242 B2
(45) Date of Patent: Jul. 21, 2015

(54) SLAG CLEARING SYSTEM AND METHOD

(71) Applicant: Nucor Corporation, Charlotte, NC (US)

(72) Inventor: David Gordon Newman, Jr., Mt. Pleasant, SC (US)

(73) Assignee: Nucor Corporation, Charlotte, NC (US)

( * ) Notice: Subject to any disclaimer, the term of this patent is extended or adjusted under 35 U.S.C. 154(b) by 108 days.

(21) Appl. No.: 13/842,132

(22) Filed: Mar. 15, 2013

(65) Prior Publication Data

US 2014/0265066 A1 Sep. 18, 2014

(51) Int. Cl.
*F27D 25/00* (2010.01)

(52) U.S. Cl.
CPC ..... *F27D 25/001* (2013.01)

(58) Field of Classification Search
CPC ..... F27D 25/001
USPC ..... 266/135, 287
See application file for complete search history.

(56) References Cited

U.S. PATENT DOCUMENTS

| | | | | |
|---|---|---|---|---|
| 5,542,650 | A * | 8/1996 | Abel et al. | 266/135 |
| 5,827,475 | A * | 10/1998 | Yamashiro et al. | 266/135 |
| 8,440,134 | B2 * | 5/2013 | Rosner et al. | 266/135 |
| 2011/0169202 | A1 * | 7/2011 | Rosner et al. | 266/135 |

* cited by examiner

*Primary Examiner* — Scott Kastler
(74) *Attorney, Agent, or Firm* — Moore & Van Allen, PLLC; Jeffrey R. Gray

(57) ABSTRACT

Embodiments of the present invention comprise systems and methods that clear (e.g., break-up, remove, or the like) the solidified slag (e.g., slag that is solidifying or has at least partially solidified) from the furnace, such as from the slag door as molten slag is removed from the furnace. The systems and methods of the present invention comprise utilizing an arm that is extendable and retractable into and out of a position for accessing an opening in a slag door. The system has a ram that extends and retracts, and may move in horizontal and vertical directions, to clear solidified slag from the slag door opening and other areas within a furnace. The systems and methods of the present invention provide for clearing of solidified slag from the furnace without putting workers in a dangerous environment and without the need for expensive retrofitting of the furnace or furnace deck.

26 Claims, 18 Drawing Sheets

SLAG CLEARING SYSTEM AND METHOD

BACKGROUND

During the process of making steel in a furnace, slag is created during the melting and refining of the steel within the furnace. The slag may be removed during processing of the steel, and may begin to solidify or become solidified either within the furnace or as the molten slag is removed from the furnace, through a door or other opening in the furnace.

BRIEF SUMMARY

Embodiments of the present invention relate to systems and methods of clearing (e.g., breaking-up, removing, moving, pushing, or the like) solidified slag (e.g., slag that is in the process of solidifying or has at least partially solidified) from the furnace, such as from the slag door or other opening in the furnace. The systems and methods of the present invention comprise moving a ram into and out of position for use and storage, extending and retracting the ram, and moving the ram in the horizontal and vertical directions to clear slag that is in the process of solidifying, or has at least partially solidified, in the slag door, other openings, or within a furnace (e.g., electric arc furnace ("EAF"), blast furnace, any other type of furnace, or the like). The systems and methods of the present invention allow for clearing solidified slag from the furnace without putting workers in a dangerous environment and without the need for expensive retrofitting of the furnace or furnace deck.

One embodiment of the invention is an apparatus comprising a pivot support, a pivot arm operatively coupled to the pivot support, a ram support operatively coupled to the pivot arm, a ram operatively coupled to the ram support, and the ram is configured to remove solidified slag from a slag door opening.

In further accord with an embodiment of the invention, the ram support comprises a vertical ram actuation device. In another embodiment of the invention, the vertical ram actuation device comprises one or more hydraulic actuators operatively coupled to the ram support and the ram, at least one first ram pin operatively coupled to the ram support and the ram, and the hydraulic actuators rotate the ram in the vertical direction around the at least one first ram pin.

In yet another embodiment of the invention, the ram support comprises a horizontal ram actuation device. In still another embodiment of the invention, the horizontal ram actuation device comprises one or more hydraulic actuators operatively coupled to the ram support and the ram, at least one second ram pin operatively coupled to the ram support and the ram, and the hydraulic actuators rotate the ram in the horizontal direction around the at least one second ram pin.

In further accord with an embodiment of the invention, the pivot arm comprises a first pivot arm operatively coupled at a first end to the pivot support and at a second end to the ram support at a first ram support mount; a second pivot arm operatively coupled at a first end to the pivot support and at a second end to the ram support at a second ram support mount; and as the first pivot arm and the second pivot arm rotate, the ram support rotates with respect to the first pivot arm and the second pivot arm at the first ram support mount and the second ram support mount.

In another embodiment of the invention, the ram comprises an extending ram actuation device, and the extending ram actuation device actuates the ram from a retracted position to an extended position.

In yet another embodiment of the invention, the pivot support comprises a base plate support, a tower support operatively coupled to the base plate support, a support shaft operatively coupled to the tower support and the pivot arm, a support actuator operatively coupled to the tower support and the support shaft, and the support actuator rotates the support shaft to move the pivot arm from a pivot arm retracted position to a pivot arm extended position.

In still another embodiment of the invention, the apparatus further comprises an anchor system operatively coupled to the pivot arm or the ram support, and the anchor system is operatively coupled for attachment or detachment to a furnace support.

In further accord with an embodiment of the invention, the pivot support is operatively coupled to a furnace deck, and the furnace deck is located adjacent to a furnace.

In another embodiment of the invention, the ram comprises a pierce tip, and the pierce tip is configured to pierce solidified slag through the slag door opening of a furnace.

Another embodiment of the invention comprises an arm base support, an arm operatively coupled to the arm base support, a ram support operatively coupled to the arm, a ram operatively coupled to the ram support, and the ram is configured to extend and retract to remove solidified slag from a slag door opening.

Another embodiment of the invention is a method comprising positioning a pivot arm into an extended arm position, wherein the pivot arm is operatively coupled to a pivot support; positioning a ram into an extended ram position, wherein the ram is operatively coupled to the pivot arm through a ram support; and clearing solidified slag from a slag door opening.

In another embodiment of the invention, the method further comprises actuating the ram in a vertical direction, wherein the ram is actuated using a vertical ram actuation device. In yet another embodiment of the invention, the vertical ram actuation device comprises one or more hydraulic actuators operatively coupled to the ram support and the ram, at least one first ram pin operatively coupled to the ram support and the ram, and actuating the ram in a vertical direction comprises using the one or more hydraulic actuators to rotate the ram in the vertical direction around the at least one first ram pin.

In still another embodiment of the invention, the method further comprises actuating the ram in the horizontal direction, wherein the ram is actuated using a horizontal ram actuation device.

In further accord with an embodiment of the invention, the horizontal ram actuation device comprises one or more hydraulic actuators operatively coupled to the ram support and the ram, at least one second ram pin operatively coupled to the ram support and the ram, and wherein actuating the ram in the horizontal direction comprises using the one or more hydraulic actuators to rotate the ram in the horizontal direction around the at least one second ram pin.

In another embodiment of the invention, the pivot arm comprises a first pivot arm operatively coupled at a first end to the pivot support and at a second end to the ram support at a first ram support mount; a second pivot arm operatively coupled at a first end to the pivot support and at a second end to the ram support at a second ram support mount; and wherein positioning the pivot arm in the extended position comprises rotating the first pivot arm and the second pivot arm, such that as the first pivot arm and the second pivot arm rotate, the ram support rotates with respect to the first pivot arm and the second pivot arm at the first ram support mount and the second ram support mount.

In yet another embodiment of the invention, the ram comprises an extending ram actuation device, and wherein positioning the ram into an extended position comprises actuating the ram from a retracted position to an extended position using the extending ram actuation device.

In still another embodiment of the invention, the pivot support comprises a base plate support, a tower support operatively coupled to the base plate support, a support shaft operatively coupled to the tower support and the pivot arm, a support actuator operatively coupled to the tower support and the support shaft, and positioning the pivot arm into an extended position comprises rotating the support shaft to move the pivot arm from a pivot arm retracted position to the pivot arm extended position.

In further accord with an embodiment of the invention, the method further comprises operatively coupling the pivot arm to a furnace support using an anchor system, wherein the anchor system is operatively coupled for attachment or detachment to the furnace support.

In another embodiment of the invention, the pivot support is operatively coupled to a furnace deck, and wherein the furnace deck is located adjacent a furnace.

In yet another embodiment of the invention, the ram comprises a pierce tip, and wherein clearing solidified slag from a slag door opening comprises piercing the solidified slag using the pierce tip.

Another embodiment of the invention is a method comprising positioning an arm into an extended arm position, wherein the arm is operatively coupled to an arm base support; positioning a ram into an extended ram position, wherein the ram is operatively coupled to the arm through a ram support; and clearing solidified slag from a slag door opening.

The features, functions, and advantages that have been discussed may be achieved independently in various embodiments of the present invention or may be combined in yet other embodiments, further details of which can be seen with reference to the following description and drawings.

BRIEF DESCRIPTION OF THE SEVERAL VIEWS OF THE DRAWINGS

Figure 1:
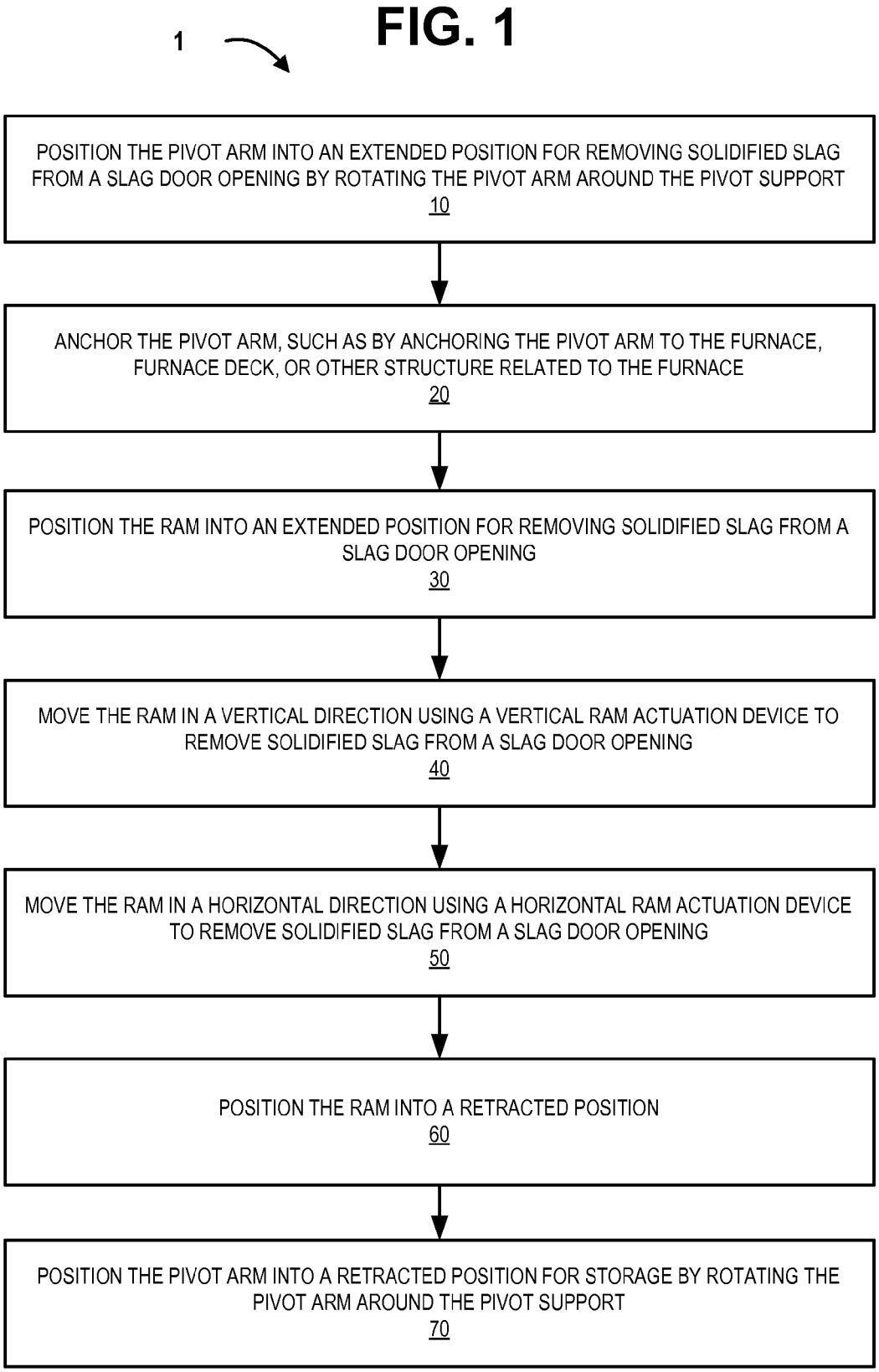
Figure 2:
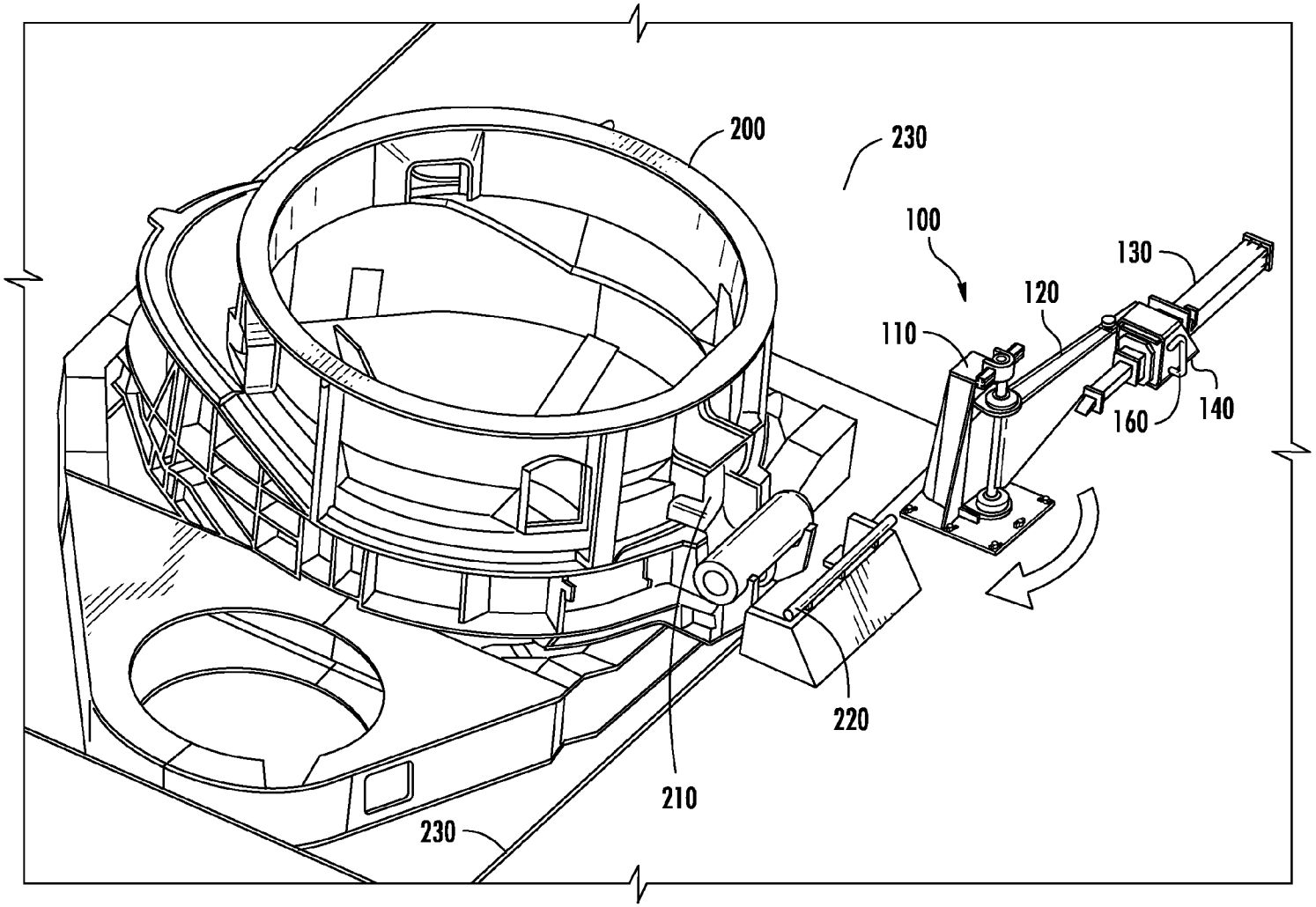
Figure 3:
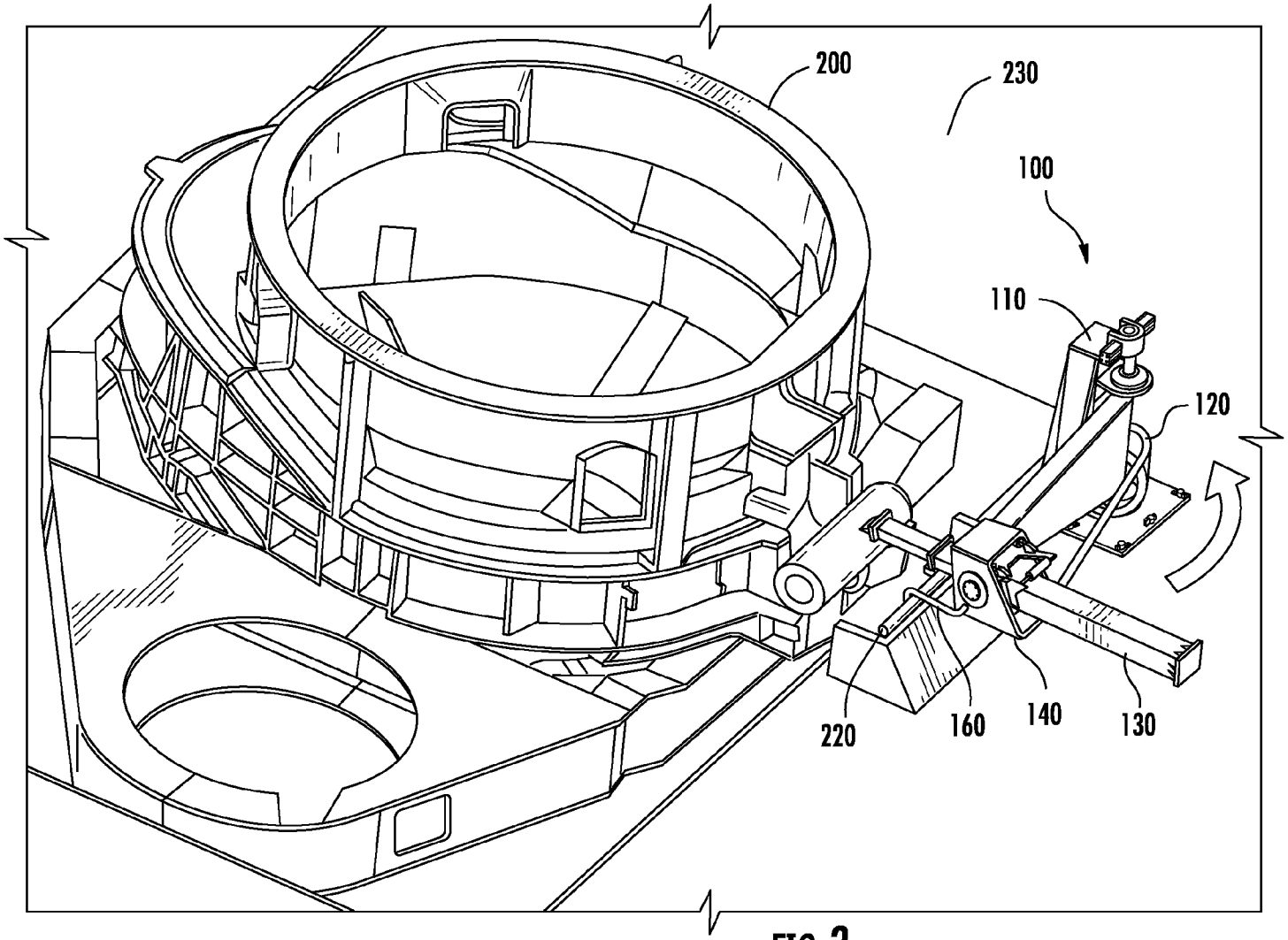
Figure 4:
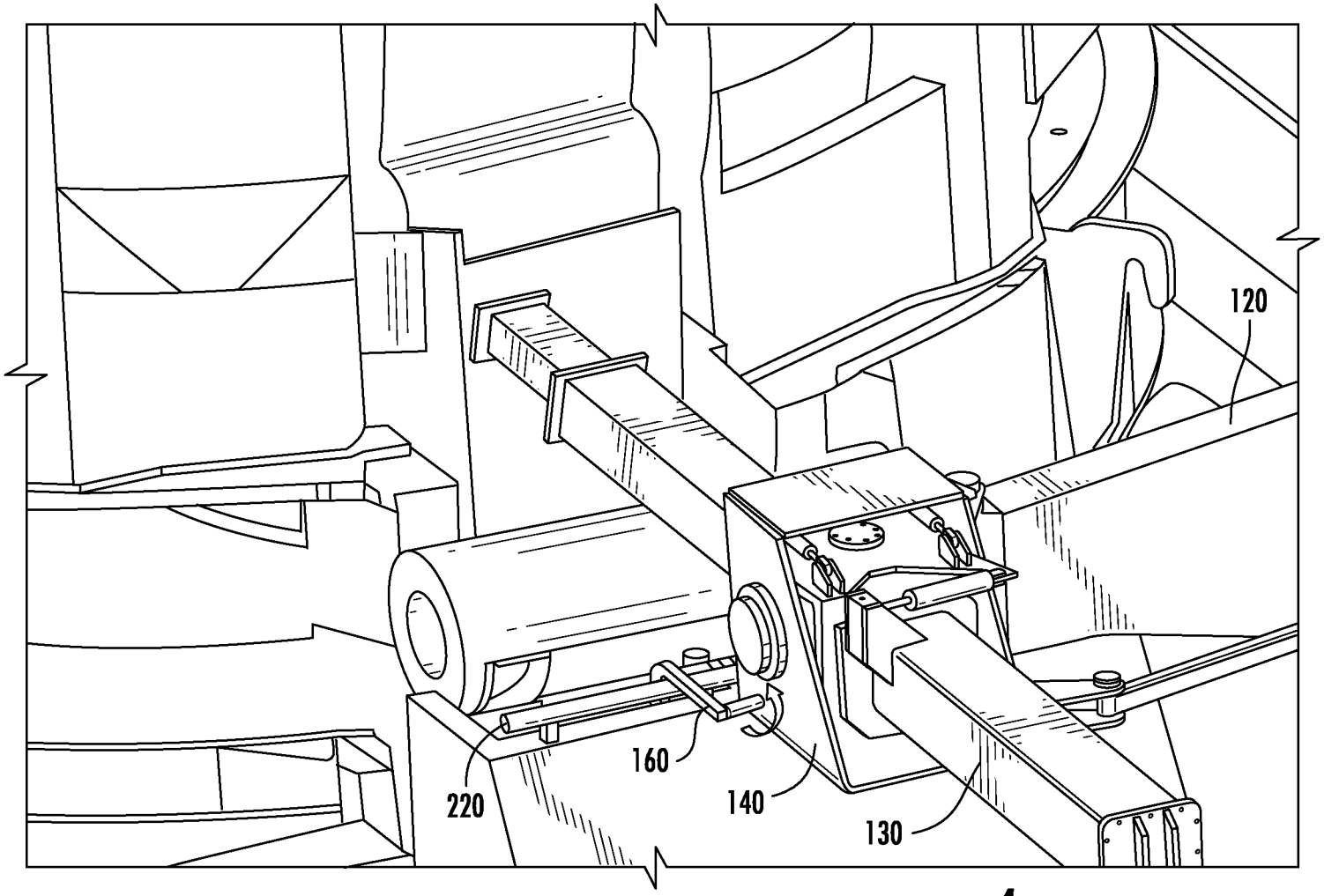
Figure 5:
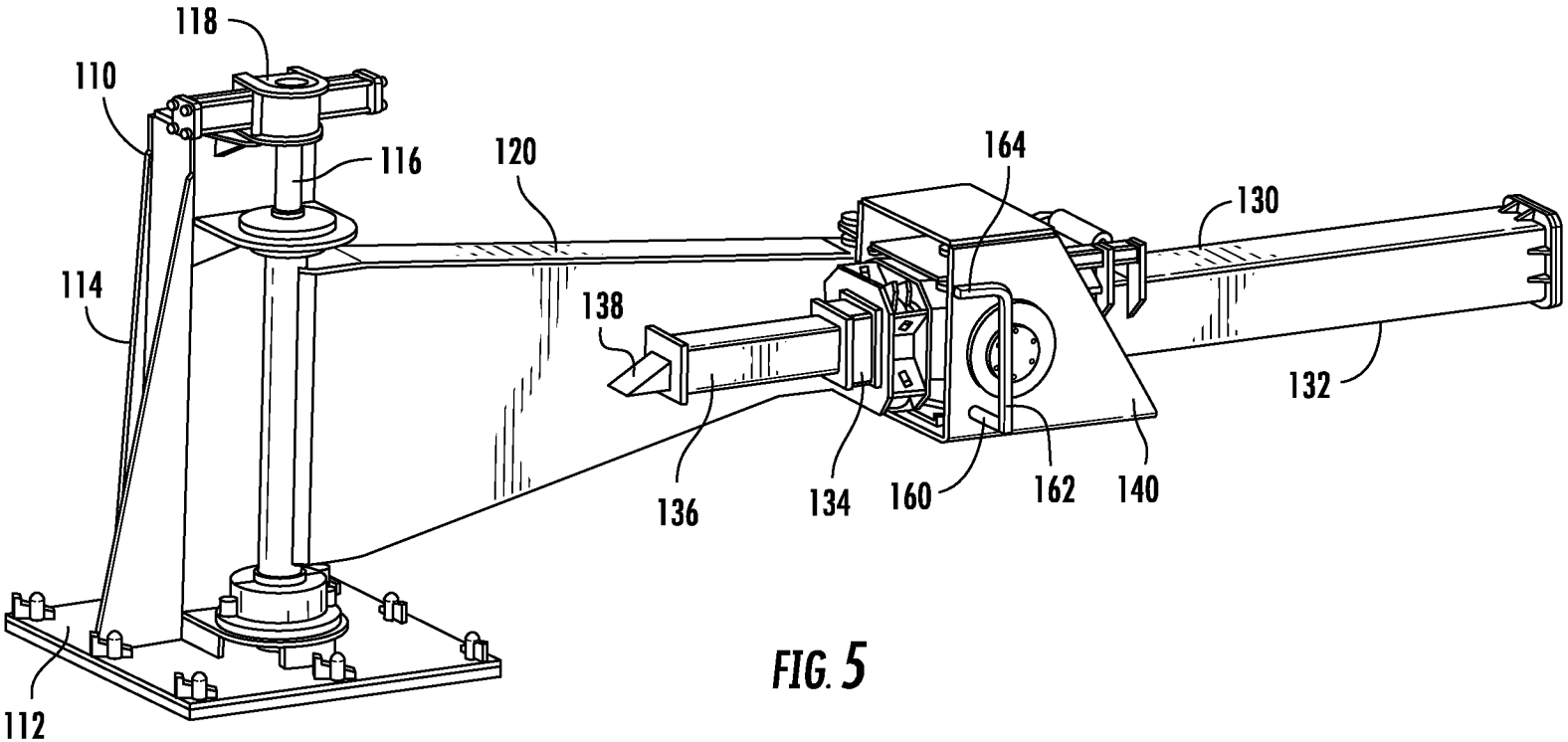
Figure 6:
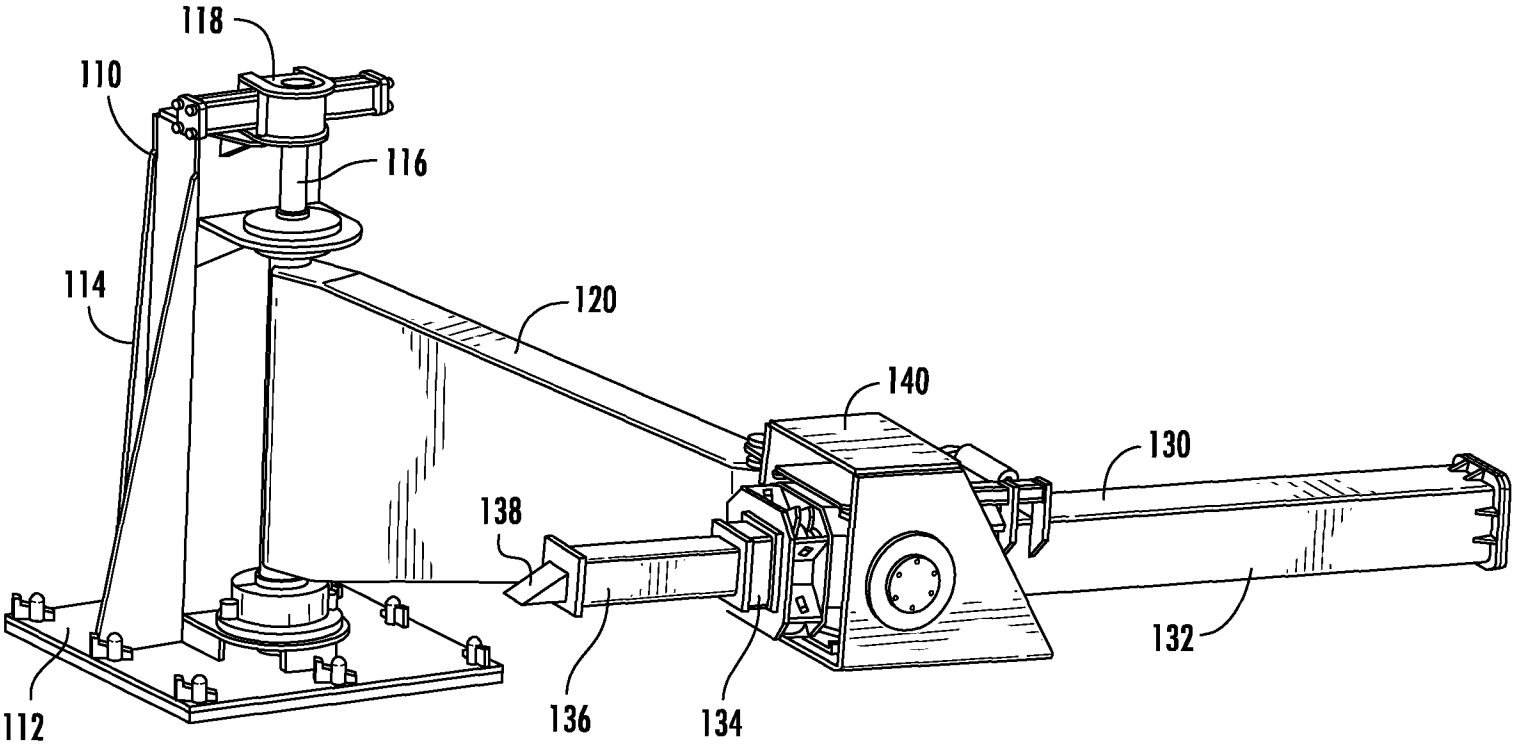
Figure 7:
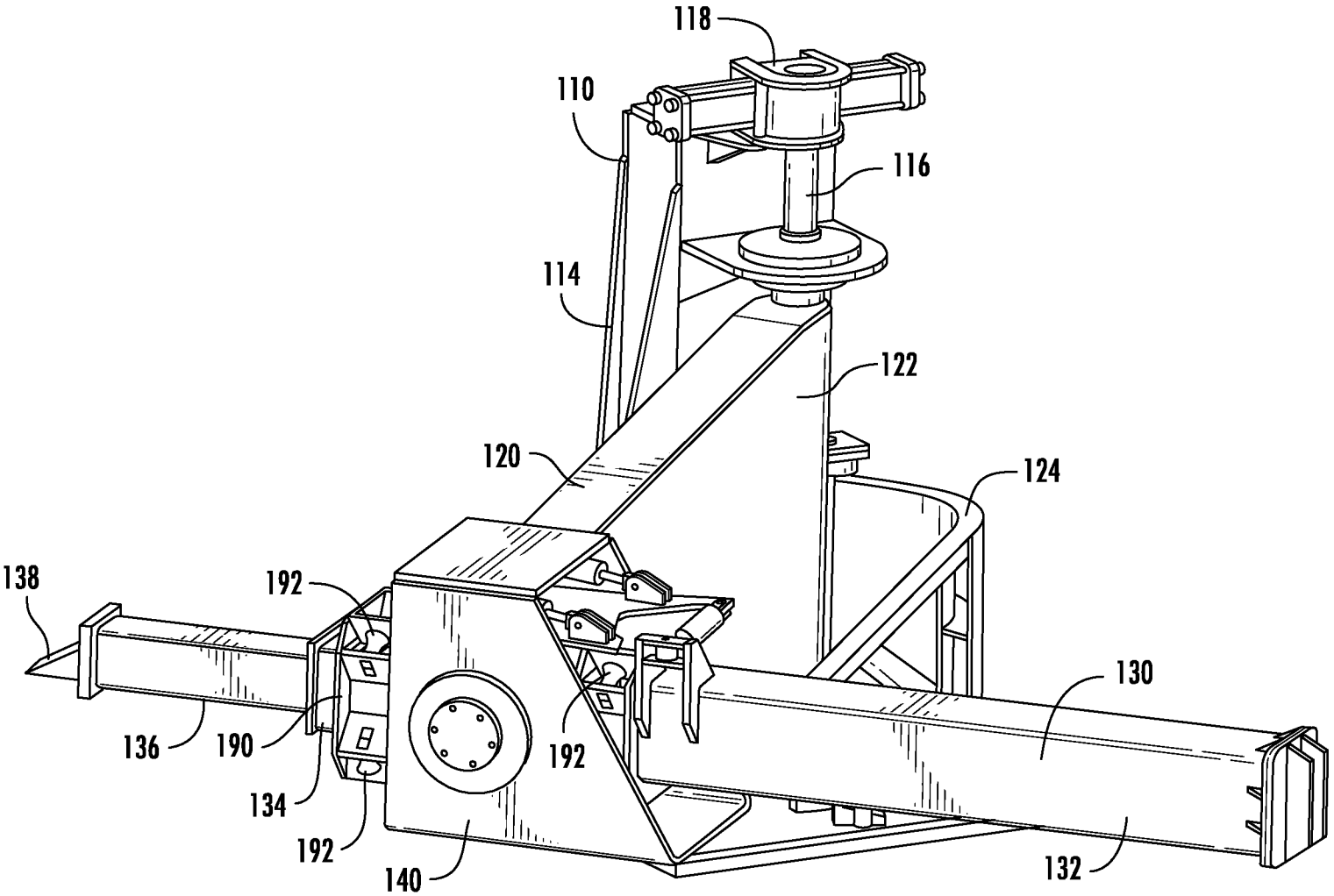
Figure 8:
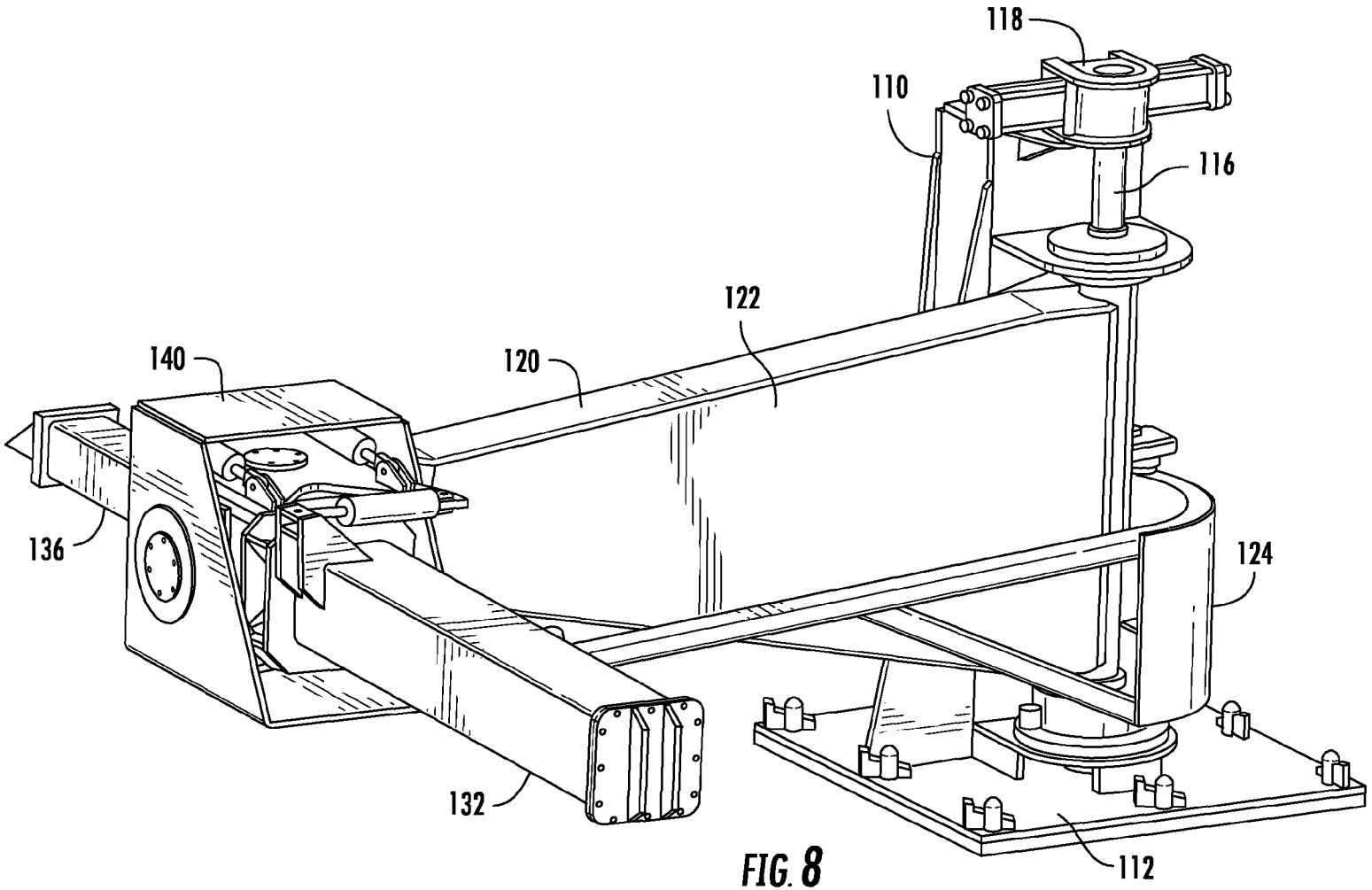
Figure 9:
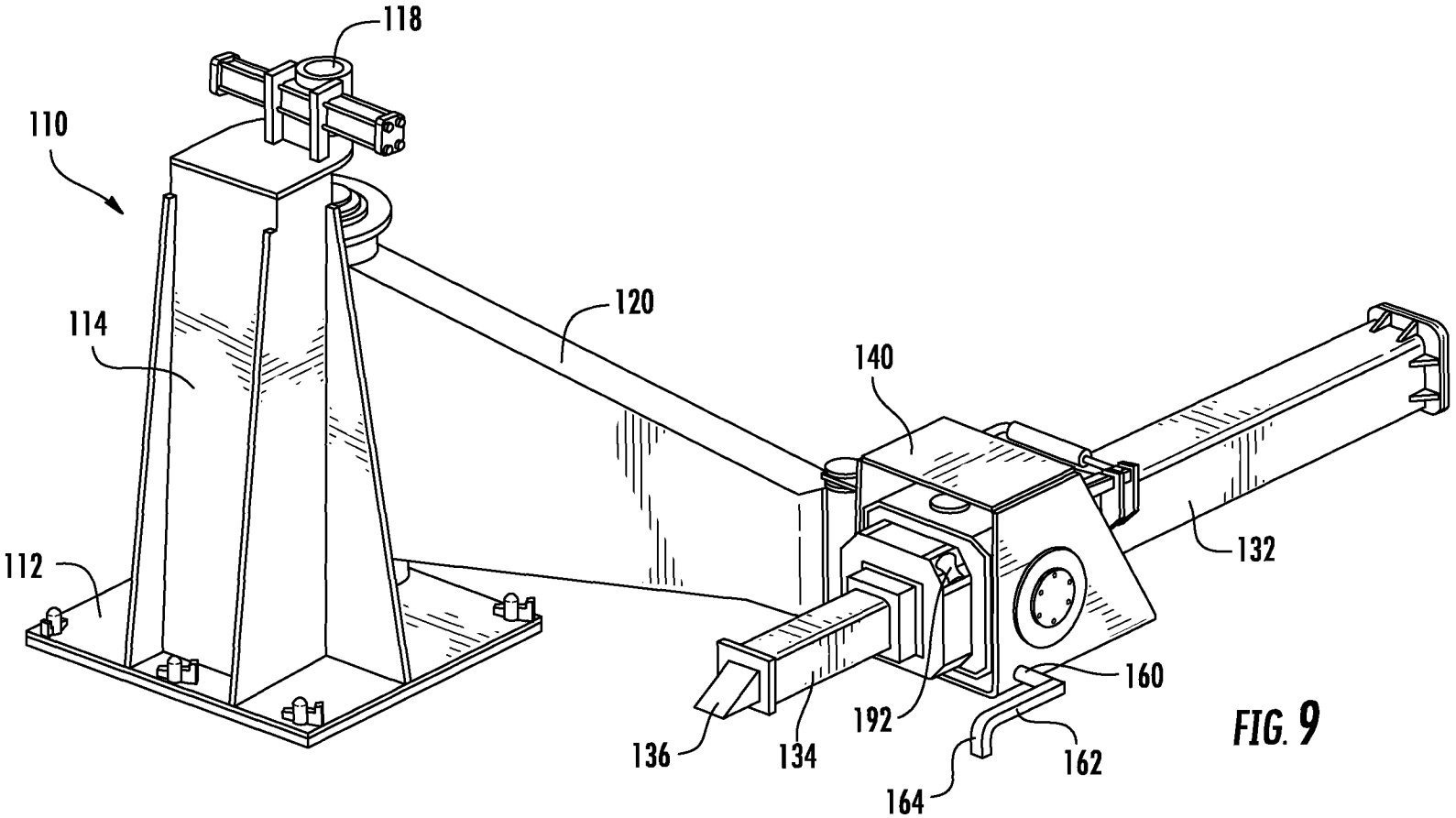
Figure 10:
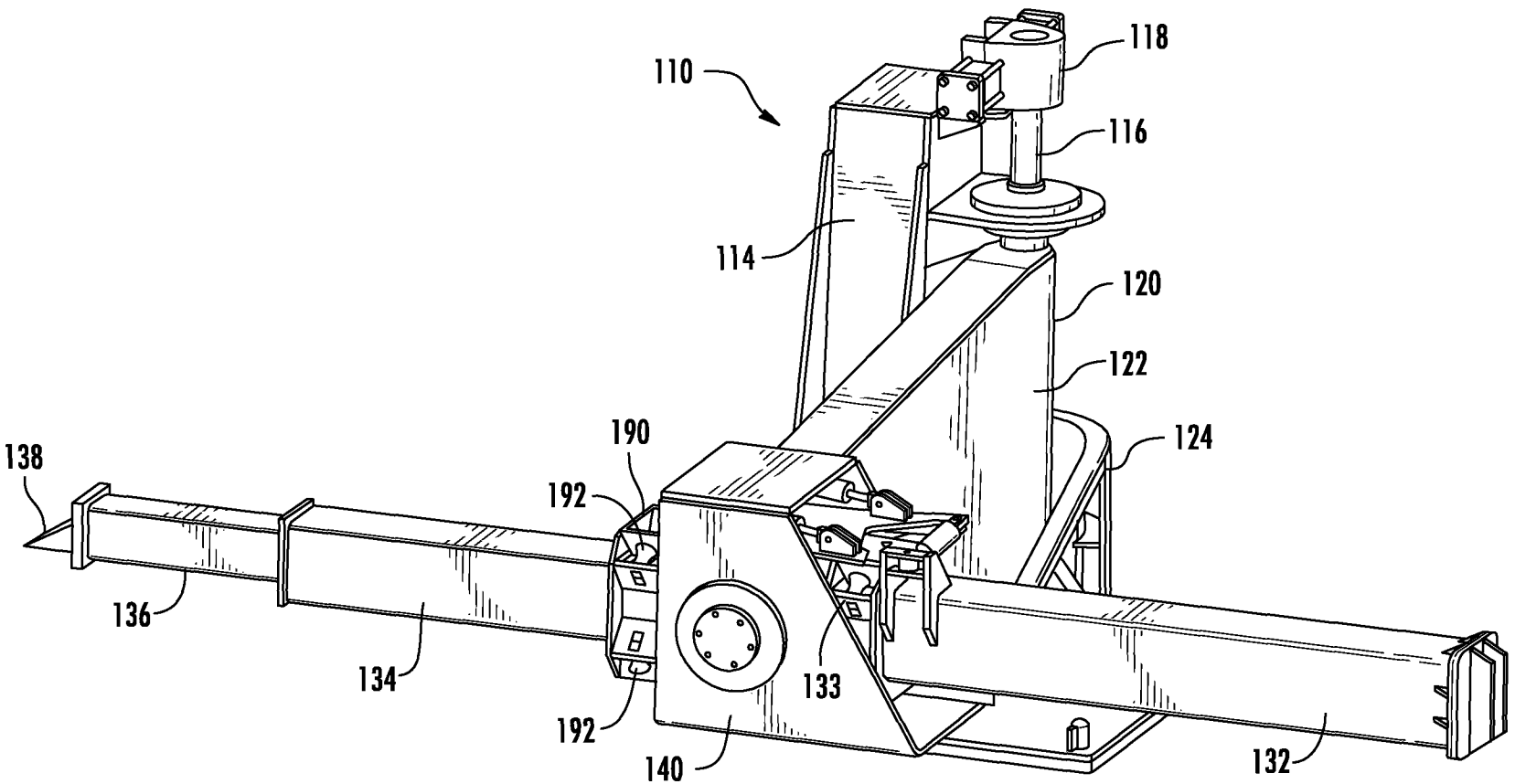
Figure 11:
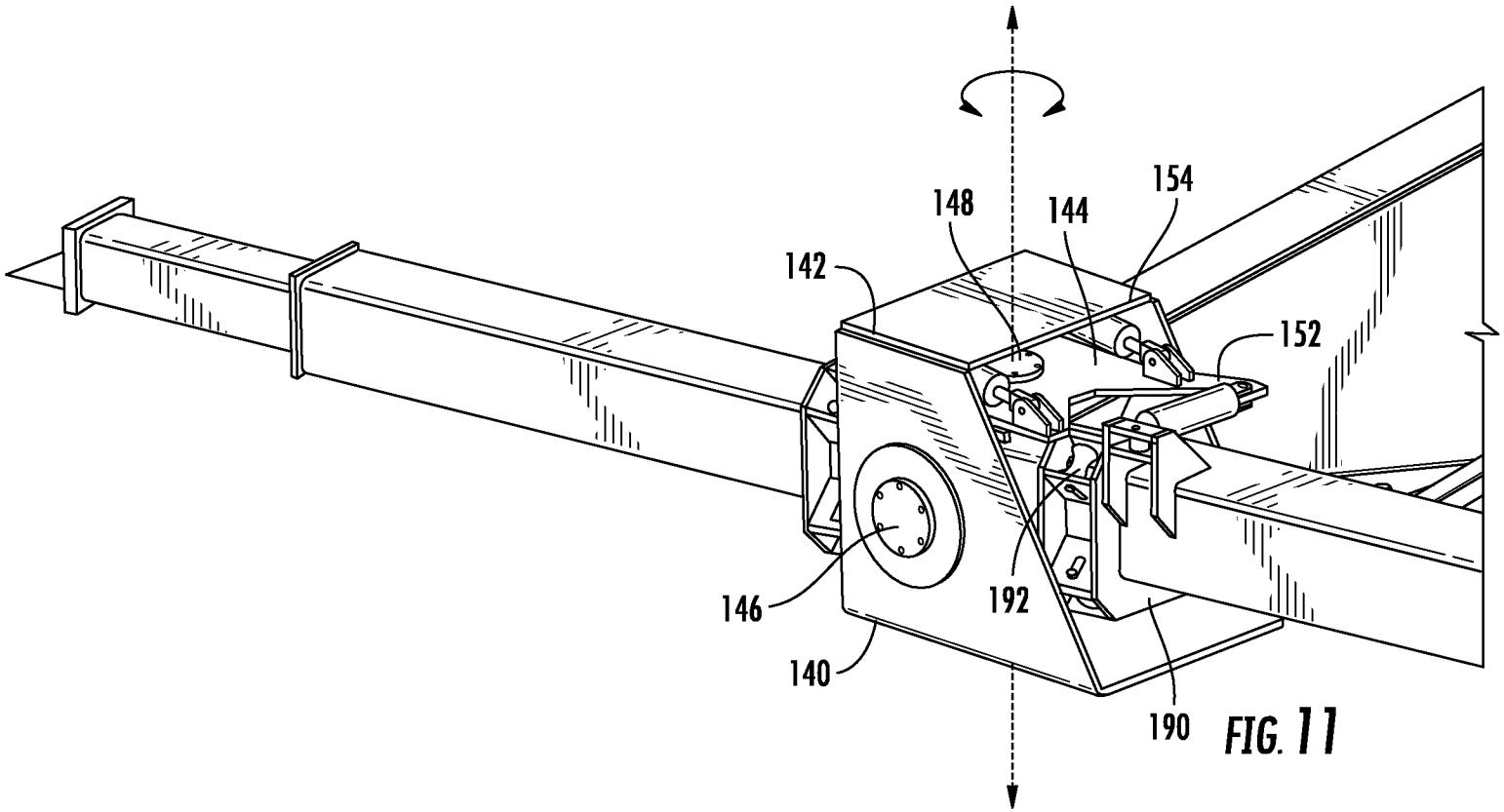
Figure 12:
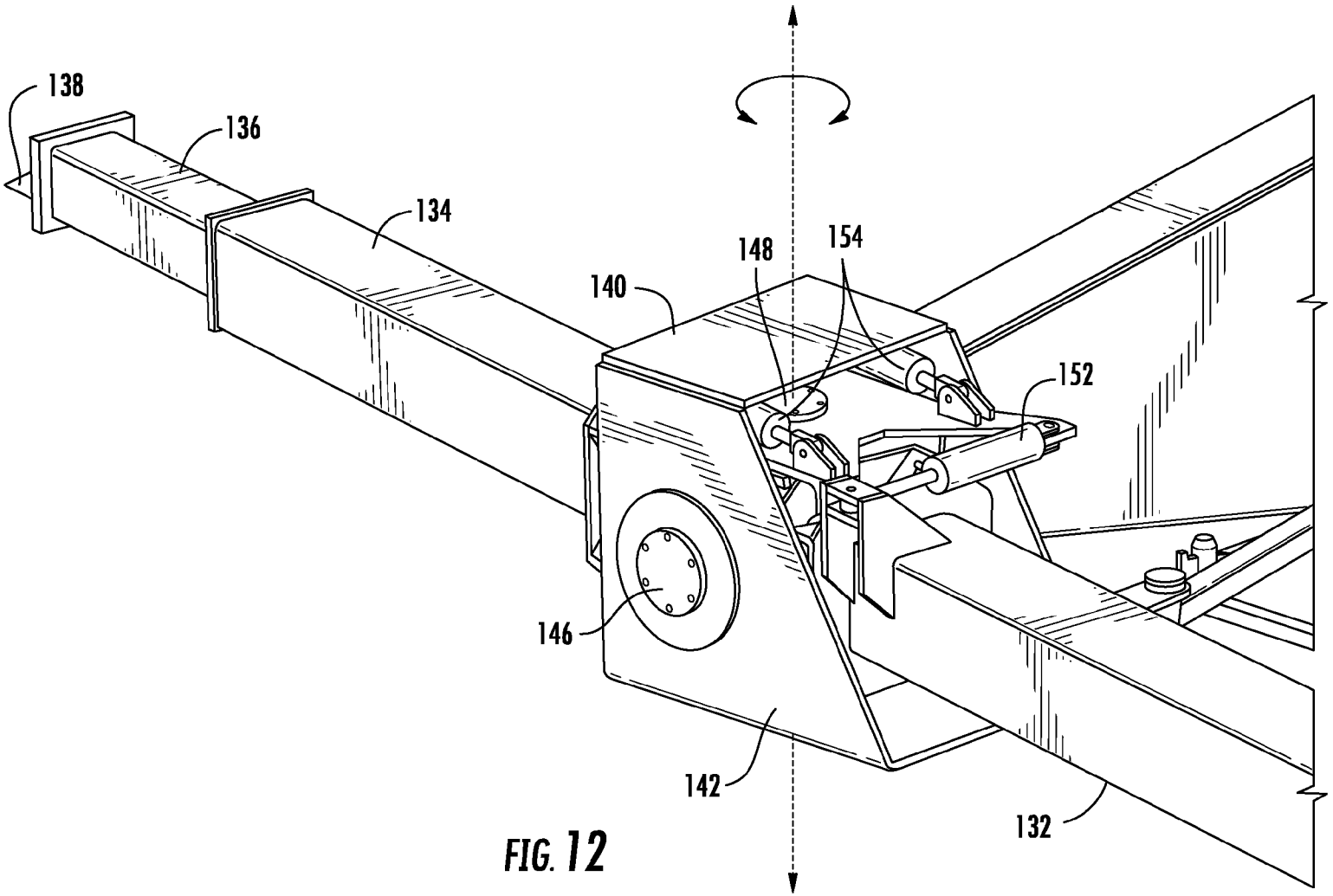
Figure 13:
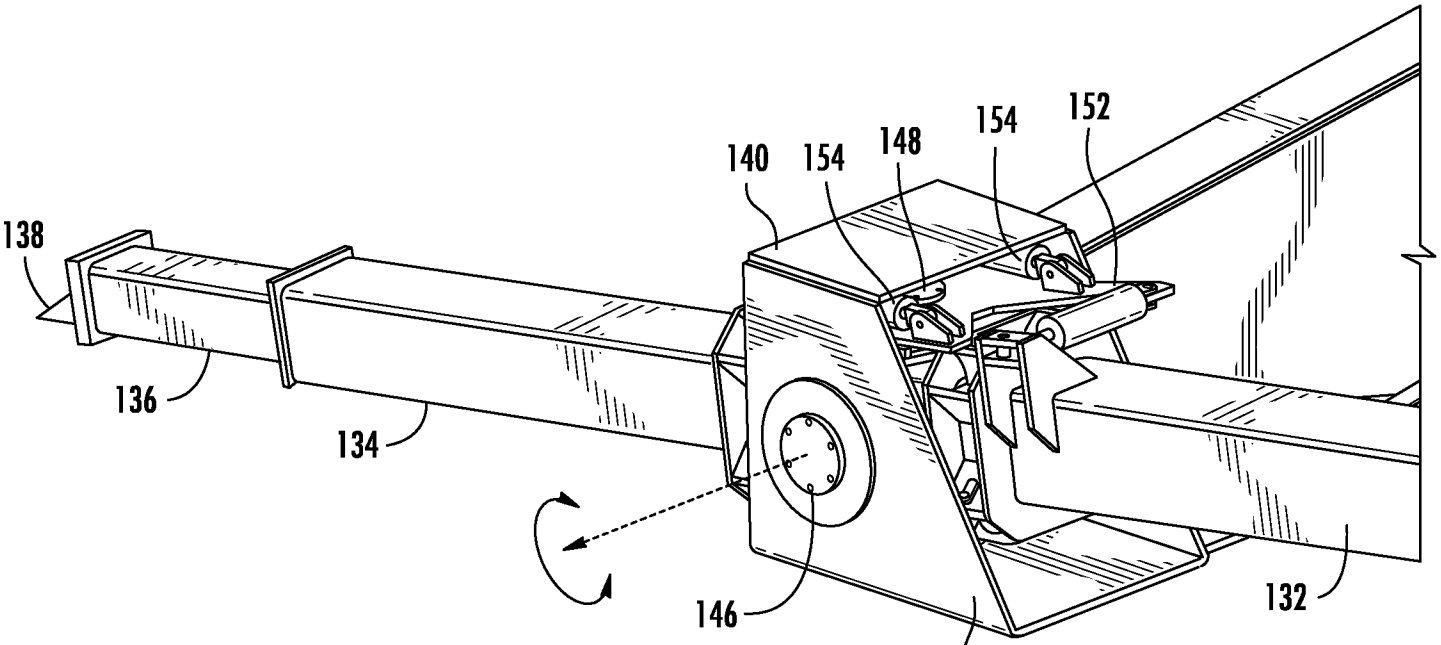
Figure 15:
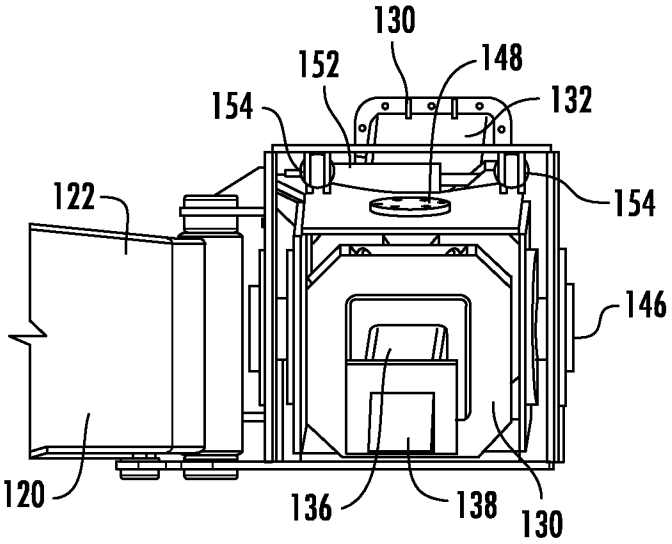
Figure 14:
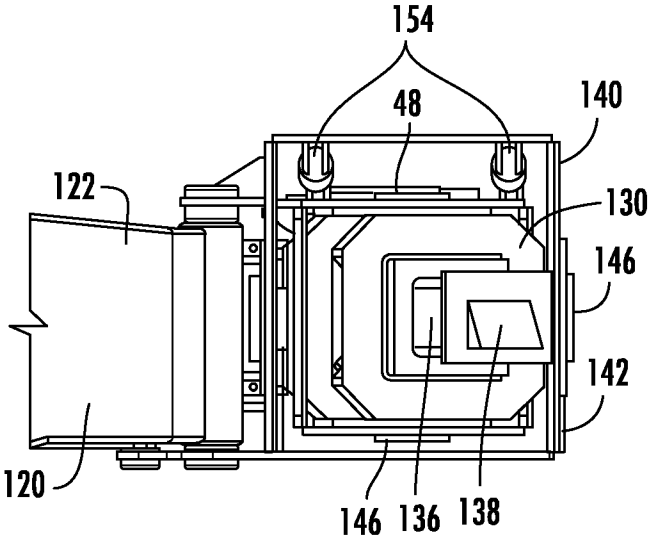
Figure 16:
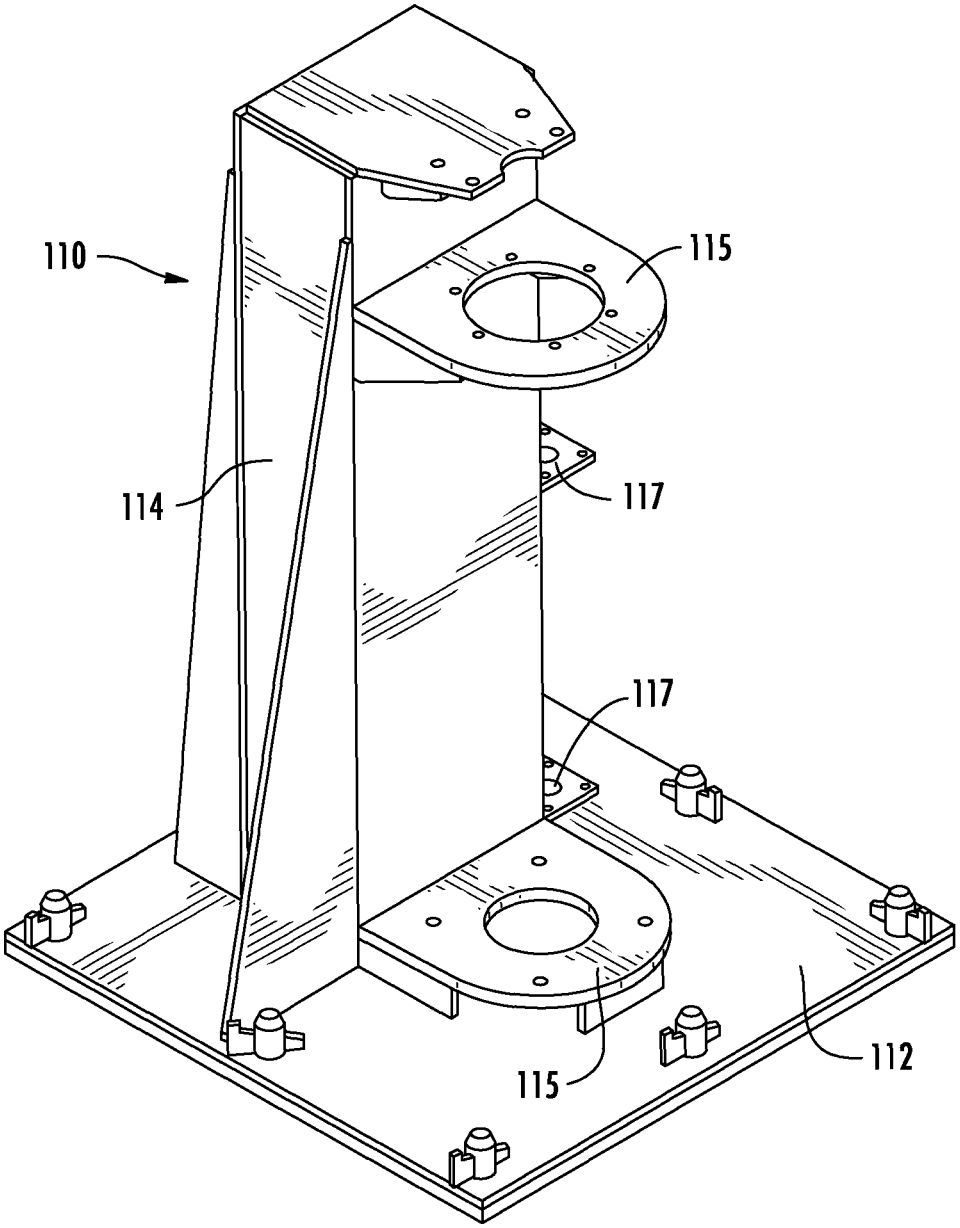
Figure 17:
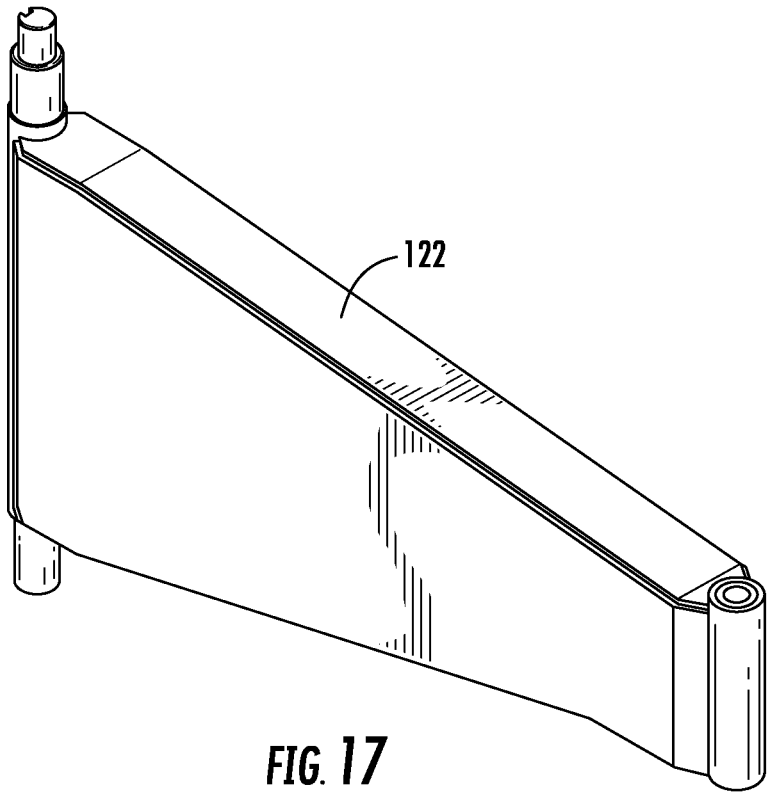
Figure 18:
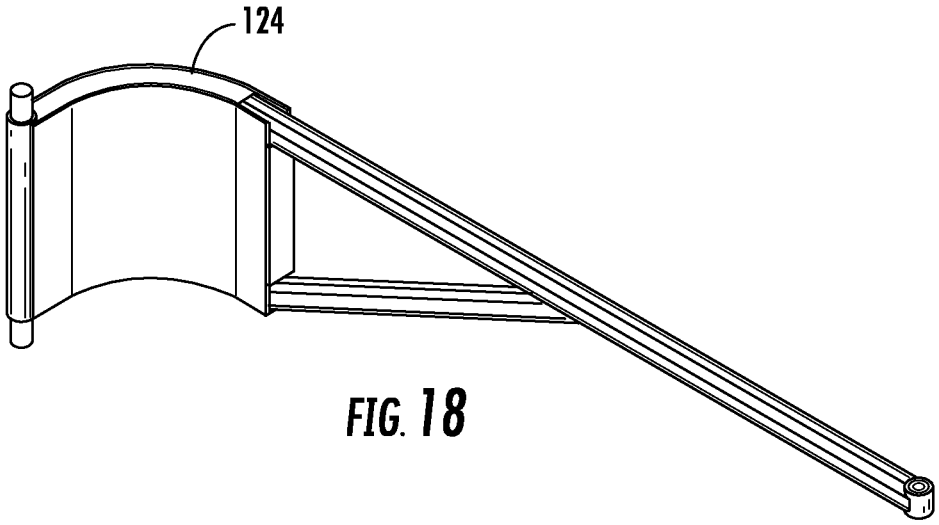
Figure 19:
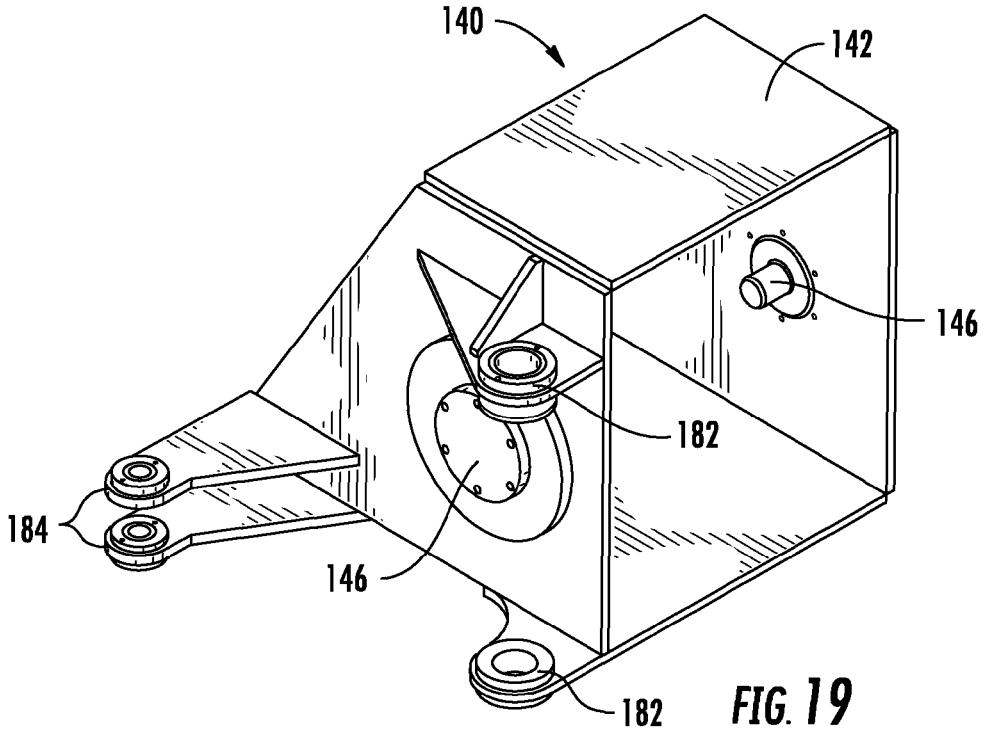
Figure 20:
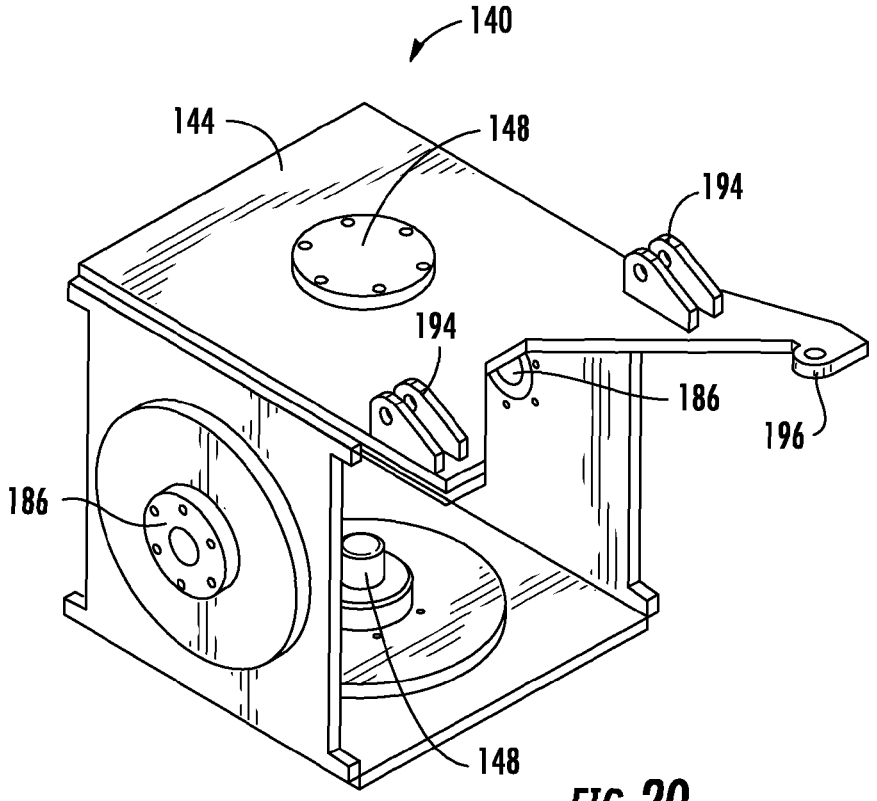
Figure 21:
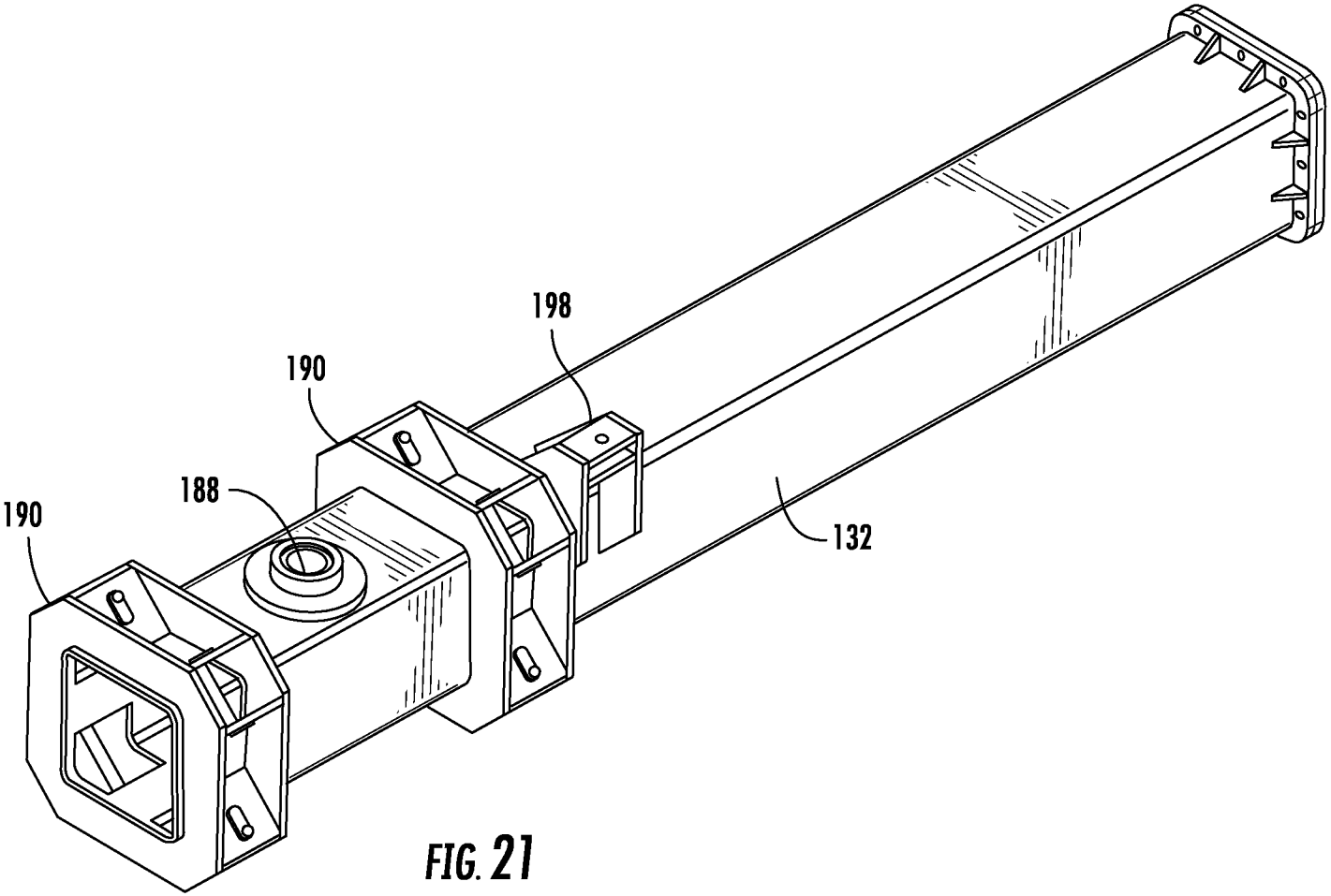

Having thus described embodiments of the invention in general terms, reference will now be made to the accompanying drawings, wherein:

FIG. 1 illustrates a process flow for using a slag clearing system to clear solidified slag, in accordance with one embodiment of the present invention;

FIG. 2 illustrates a perspective view of an electric arc furnace and slag clearing system with an arm in a retracted arm position, in accordance with one embodiment of the present invention;

FIG. 3 illustrates a perspective view of an electric arc furnace and slag clearing system with an arm in an extended arm position, in accordance with one embodiment of the present invention;

FIG. 4 illustrates a perspective view of an electric arc furnace and slag clearing system with an arm in an extended arm position and a ram in an extended ram position, in accordance with one embodiment of the present invention;

FIG. 5 illustrates a perspective view of a slag clearing system with an arm in a retracted arm position, in accordance with one embodiment of the present invention;

FIG. 6 illustrates a perspective view of a slag clearing system with an arm in an intermediate arm position between a retracted arm position and an extended arm position, in accordance with one embodiment of the present invention;

FIG. 7 illustrates a perspective view of a slag clearing system with an arm in an intermediate arm position between a retracted arm position and an extended arm position, in accordance with one embodiment of the present invention;

FIG. 8 illustrates a perspective rear view of a slag clearing system with an arm in an extended arm position, in accordance with one embodiment of the present invention;

FIG. 9 illustrates a perspective front view of a slag clearing system with an arm in an extended arm position, in accordance with one embodiment of the present invention;

FIG. 10 illustrates a perspective view of a slag clearing system with an arm in an extended arm position and with a ram in an extended ram position, in accordance with one embodiment of the present invention;

FIG. 11 illustrates a perspective view of a slag clearing system with an arm in an extended arm position and with a ram in an extended ram position actuated in a first horizontal direction, in accordance with one embodiment of the present invention;

FIG. 12 illustrates a perspective view of a slag clearing system with an arm in an extended arm position and with a ram in an extended ram position actuated in a second horizontal direction, in accordance with one embodiment of the present invention;

FIG. 13 illustrates a perspective view of a slag clearing system with an arm in an extended arm position and with a ram in an extended ram position actuated in a vertical direction, in accordance with one embodiment of the present invention;

FIG. 14 illustrates a front view of a slag clearing system with an arm in an extended arm position and with a ram in an extended ram position actuated in a horizontal direction, in accordance with one embodiment of the present invention;

FIG. 15 illustrates a front view of a slag clearing system with an arm in an extended arm position and with a ram in an extended ram position actuated in vertical and horizontal directions, in accordance with one embodiment of the present invention;

FIG. 16 illustrates a perspective view of a pivot support, in accordance with one embodiment of the present invention;

FIG. 17 illustrates a perspective view of a pivot support arm, in accordance with one embodiment of the present invention;

FIG. 18 illustrates a perspective view of a pivot actuation arm, in accordance with one embodiment of the present invention;

FIG. 19 illustrates a perspective view of an outer ram support housing, in accordance with one embodiment of the present invention;

FIG. 20 illustrates a perspective view of an inner ram support housing, in accordance with one embodiment of the present invention; and FIG. 21 illustrates a perspective view of a ram housing, in accordance with one embodiment of the present invention.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

FIG. 1 illustrates a slag clearing process 1 in accordance with one embodiment of the invention. During the process of making steel, slag is formed and floats on the surface of the melting and molten steel. The slag is a by-product of the steel making process and is formed from the impurities that are separated from melting steel. Slag is present in the process of smelting ore to make steel, and when scrap steel is melted in an electric arc furnace. The slag can be beneficial to the steel making process for creating a blanket that covers the walls and arcs of the furnace, which increases the thermal efficiency, provides better arc stability for increasing electrical efficiency, and prevents damage to the furnace from radiant heat. The foaming slag is in the molten liquid form and is often present throughout the steelmaking process. In some instances, at least a portion of the slag may be removed, such as if too much slag has formed in the furnace, or before the process of tapping the furnace to remove the molten steel begins. In order to remove the slag from the furnace, a slag door on the side of the furnace wall is opened and the furnace is tilted to pour at least some of the molten slag out of the furnace. The slag may be poured into a slag pot located below the furnace deck, which is positioned to catch the slag being poured from the furnace. As the molten slag is poured out of the slag door opening, some of the slag begins to cool. The furnace walls are often water cooled to prevent the molten metal and electric arcs from damaging the furnace walls. Therefore, as molten slag is poured out of the slag door opening, the water-cooled edges of the slag door, and/or the outside air, at least partially solidify some of the molten slag exiting the slag door opening. If too much of the slag solidifies, the slag door opening may become blocked and the amount of slag that can be poured out of the slag door opening may be reduced or even stopped completely. In other situations, such as after the slag has been removed and the furnace prepared for tapping, or otherwise after tapping, the slag may also solidify around the slag door, on top of the remaining molten metal in the furnace, or within the furnace in general. The slag clearing system and process of the present invention may be used in order to break apart, remove, or otherwise clear the solidifying or solidified slag from different areas of the furnace, and in particular, from the slag door opening.

FIG. 1 generally illustrates a process for using a slag clearing system 100 to clear solidified slag from the slag door opening. The slag clearing system 100 comprises an arm base support (e.g., pivot support 110), an arm (e.g., a pivot arm 120), a ram 130, and a ram support 140. The pivot support 110 is operatively coupled to the decking that surrounds the EAF at a location off to the side of, or adjacent to, the EAF. The pivot arm 120 is rotated from a retracted arm position to an extended arm position, and thereafter, the ram 130 is actuated from a retracted arm position to an extended ram position, to clear solidified slag from the slag door opening. The ram 130 may also be moved in vertical and horizontal directions by either moving the ram support 140, or moving the ram 130 with respect to the ram support 140, in order to further clear solidified slag from the slag door opening.

As illustrated in block 10 of FIG. 1, the slag clearing process 1 comprises positioning the arm of the slag clearing system 100 into an extended position. For example in the illustrated embodiment the arm is a pivot arm 120 and positioning the arm comprises rotating the pivot arm 120 from a retracted pivot arm position (see FIGS. 2 and 5) into an extended pivot arm position (see FIGS. 3, 8, and 9). In the illustrated embodiment as shown in FIGS. 7 and 8, and as described in further detail later, the pivot arm 120 may comprise a first pivot support arm 122, and a second pivot actuation arm 124. The pivot support arm 122 and the pivot actuation arm 124 are both secured to a ram support 140 at first ends and at different locations on the ram support 140, such that as the pivot support arm 122 is rotated into the extended arm position the pivot actuation arm rotates the ram support 140 away from the pivot support arm 122 and into the desired position in front of the slag door. In other embodiments of the invention, the pivot arm 120 may comprise a single arm that is operated by hydraulics, gear system, or other devices that both position the arm of the slag clearing system 100 into the extended arm position, and also position the ram support 140 in the desired orientation in front of the slag door. In still other embodiments of the invention, the pivot arm 120 may be a different type of arm that folds up in one or more locations to further compact the slag clearing system 100 when the arm is located in the retracted arm position. In still other embodiments of the invention the pivot arm 120 may also fold up. In still other embodiments of the invention the arm may work in a number of different ways to move between an extended arm position and a retracted arm position.

As illustrated in block 20 of FIG. 1, one or more anchor systems 160 (see FIGS. 3, 4, 5, and 9) may be utilized to operatively couple the pivot arm 120 to the furnace 200 or furnace deck 230. In some embodiments the pivot arm 120 is operatively coupled to a furnace support bar 220 that is operatively coupled to the furnace 200 or the furnace deck 230. In some embodiments, the anchor system 160 may be operatively coupled to the ram support 140. The anchor system 160, as illustrated, may be one or more anchor members 162 with one or more hooks 164, which may be operatively coupled to the furnace support bar 220 when the pivot arm 120 or other type of arm is located in the extended arm position. The anchor members 162 may be extended or retracted for coupling and decoupling the pivot arm 120 from the furnace 200, furnace deck 230, or other support structure adjacent the furnace 200. The anchor system 160 may be extended or retracted through the use of an actuator, such as a hydraulic actuator. The anchor system 160, as explained in further detail later, may be utilized to provide an anchor for supporting the slag clearing system 100 as the ram 130 clears the solidified slag from the opening of the slag door 210 of the furnace 200. The anchor system 160 may be used to provide an opposing force for the ram 130 as the ram 130 is extended to clear solidified slag from the furnace 200. Without the anchor system 160 the pivot arm 120 may not provide enough of an opposing force for the ram 130, such that as the ram 130 contacted the solidified slag instead of clearing the slag the ram 130 could move the pivot arm 120 from the extended position back to an intermediate position. In other embodiments of the invention, the anchor system 160 may be operatively coupled to another component of the slag clearing system 100 and may be operatively coupled to other locations on the furnace 200, to a location on the furnace deck 230, or otherwise to another component attached to the furnace 200 or furnace deck 230, in order to provide an anchor during the slag clearing process.

Block 30 of FIG. 1 illustrates that the ram 130 of the slag clearing system 100 is moved from a retracted ram position (see FIGS. 3, 8, and 9) into an extended ram position (see FIGS. 4 and 10-13), in order to clear out at least some of the solidified slag from the slag door opening. In the illustrated embodiment, as explained in further detail later, the ram 130 may comprises a ram housing 132, an actuating ram 134, and a piercing ram 136, with a pierce head 138 attached to the piercing ram 136. The ram 130 is actuated between a retracted ram position and an extended ram position. In the illustrated embodiment the actuating ram 134 is extended and retracted using a ram actuating system comprising actuators, such as hydraulic actuators (not illustrated), located either within or outside of the ram 130 or ram housing 132. The actuating system may also comprise rollers 192 to facilitate the extension and retraction of the ram 130. The rollers 192 may be operatively coupled to the ram housing 132, such as to the ram supports 190 of the ram housing 132. In other embodiments of the invention, the ram 130 may have more or less components than are described herein, which may or may not be retractable or extendable between operation and storage of the ram 130. For example, there may be two actuating rams that are both extendable relative to the ram housing 132, as well as to each other.

As illustrated in block 40 of FIG. 1, the ram 130 may also be moved in a vertical direction (e.g., vertically up or down) using a vertical ram actuation device 154 (see FIGS. 13 and 15). In the illustrated embodiment, the ram support 140 may comprise a ram support outer housing 142 and a ram support inner housing 144 operatively coupled to each other through first pivot pins 146 and a vertical actuation device 154, such as one or more actuators (e.g., hydraulic actuators). The vertical actuation device 154 is operatively coupled to the support outer housing 142 and the support inner housing 144, such that when the vertical actuation device 154 is actuated the inner housing 144 is rotated around the first pivot pins 146 for moving the ram 130 in the vertical direction. The vertical movement allows the ram 130 to access and clear the solidified slag from different vertical locations within the opening of the slag door 210. In other embodiments of the invention, the ram 130 may be moved in a vertical direction using other types of vertical ram actuation devices 154 and structural configurations.

Block 50 of FIG. 1, illustrates that the ram 130 of the slag clearing system 100, may be moved in a horizontal direction (e.g., horizontally to the left or right) using a horizontal ram actuation device 152 (see FIGS. 11, 12, and 14). In the illustrated embodiment, the ram support 140 may comprise a ram support inner housing 144 operatively coupled to the ram housing 132 through second pivot pins 148 and a horizontal actuation device 152, such as one or more actuators (e.g., hydraulic actuators). The horizontal actuation device 152 is operatively coupled to the ram support inner housing 144 and the ram 130 (e.g., the ram housing 132). When the horizontal actuation device 152 is actuated, the ram 130 is rotated around the second pivot pins 148 within the ram support inner housing 144, such that the ram 130 is moved in the horizontal direction. The horizontal movement allows the ram 130 to access and clear the solidified slag from horizontal locations within the opening of the slag door 210. In other embodiments of the invention, the ram 130 may be moved in a horizontal direction using other types of horizontal ram actuation devices 154 and structural configurations.

As illustrated in block 60 of FIG. 1, after the solidified slag in the slag door is sufficiently cleared by the ram 130, the ram 130 may be moved back into a retracted position for storage using the ram actuating system. In the illustrated embodiment, the actuating ram 134 is pulled back into the ram housing 132, and the piercing ram 136 remains located outside of the ram housing 132.

Block 70 of FIG. 1 illustrates that the pivot arm 120 may be moved back into a retracted pivot position for storage until the slag clearing system 100 is required in the future for additional slag clearing. Typically, the opening of the slag door 210 may be cleared every time the furnace 200 is tipped to remove molten slag. In the illustrated embodiment, as previously discussed with respect to moving the pivot arm 120 into the extended arm position, the pivot arm 120 comprises a first pivot support arm 122, and a second pivot actuation arm 124. The pivot support arm 122 and pivot actuation arm 124 are both secured to the ram support 140 at different locations, such that as the pivot support arm 122 is rotated back into the retracted arm position, the pivot actuation arm 124 rotates the ram support 140 into a retracted position against the pivot support arm 122. In other embodiments of the invention, the pivot arm 120 may comprise a single arm that is operated by hydraulics, gear assemblies, and/or other devices to both rotate the slag clearing system 100 into the retracted pivot position and to position the ram support 140 in the desired retracted position. In still other embodiments of the invention, the pivot arm 120 may fold in one or more locations along the arm to further compact the slag clearing system 100 when the pivot arm 120 is located in the retracted arm position.

The slag clearing system 100 has been generally described with respect to the slag clearing process 1 of FIG. 1. However, the illustrated slag clearing system 100 and alternative embodiments of the invention will be described in further detail below. As illustrated in FIGS. 2 and 3 the slag clearing system 100 may be secured to the furnace deck 230 on one side of the furnace 200 such that access to the furnace, for example to the opening of the slag door 210, is not obstructed by the slag clearing system 100 when the pivot arm 120 of the slag clearing system 100 is located in the retracted arm position. In the illustrated embodiment, the slag clearing system 100 is located to the right of the furnace 200 and slag door 210; however, in other embodiments the slag clearing system 100 may be located to the left of furnace 200 and slag door 210, and consequently, the components of the slag clearing system 100 would be in the opposite configuration as they are illustrated and described herein. Multiple slag clearing devices 100 may be installed in various positions as needed when a facility has two or more furnaces.

FIG. 5 illustrates one embodiment of the slag clearing system 100 comprising a pivot support 110, a pivot arm 120, a ram 130, and a ram support 140. The pivot support 110 comprises a pivot support base 112 that is used to operatively couple the slag clearing system 100 to the furnace deck 230, for example through the use of bolts or other coupling means. The pivot support based 112 is operatively coupled (e.g., welded in the illustrated embodiment) to a pivot support tower 114. In some embodiments the pivot support tower comprises mounting plates 115, 117, that are used to secure the pivot arm 120 (e.g., the pivot support arm 122 and the pivot actuation arm 124). In the illustrated embodiment the pivot arm is operatively coupled to the support tower 114 through the use of a pivot support shaft 116. The support tower 114 is further operatively coupled to a pivot arm actuator 118, which is in turn operatively coupled to the pivot support shaft 116. In the illustrated embodiment the pivot arm actuator 118 is a rack and pinion actuator that may by hydraulically and/or electrically operated. In other embodiments of the invention, the pivot arm actuator 118 may comprise a drive screw, a rod and piston, or other type of actuation device. Furthermore, bearings may be utilized on the pivot support tower 114 to allow the pivot support shaft 116 to rotate within the pivot support tower 114 as the pivot arm 120 is extended and retracted.

As illustrated by FIGS. 5 through 9, the pivot support 110 and the pivot arm 120 are configured to allow the slag clearing system 100 to rotate from a retracted arm position, to intermediate arm positions, and finally to an extended arm position. Instead of rotating the ram 130 into position in front of the slag door 210, in some alternative embodiments of the invention the pivot arm 120 may be a different type of arm that may be retracted and extended using a hinged accordion configuration, collapsible configuration (e.g., similar to the ram disclosed herein), or other type of configuration. The other types of arms may also allow a slag clearing system 100 to be retracted away from the furnace 200 and slag door 210 to allow access to the furnace 200 and slag door 210 when in storage, and extended to a position in front of the furnace 200 and slag door 210 when clearing slag from the opening in the slag door 210 or from within the furnace 200 itself.

FIGS. 7 and 8 illustrate an embodiment of the invention, in which the pivot arm 120 comprises a first pivot support arm 122 and a second pivot actuation arm 124 that work in conjunction with each other to rotate the ram support 140 into position in front of the slag door 210. In the illustrated embodiment, the support pivot arm 122 is used as a structural support for the ram support 140 and the ram 130, while the pivot actuation arm 124 is used to pivot the ram support 140 away from the pivot support arm 122. In some embodiments of the invention the pivot support arm 122 is operatively coupled to the pivot support 110 at the pivot support mounts 115 for rotation, as previously described with respect to the pivot arm 120. The pivot actuation arm 124 is also operatively coupled to the pivot support 110 at the pivot actuation mounts 117 in a similar fashion for rotation, as described with respect generally to the pivot arm 120. As illustrated in FIG. 19, the pivot support arm 122 is operatively coupled to the ram support 140 at a first ram support mount 182, and the pivot actuation arm 124 is operatively coupled to the ram support 140 at a second ram support mount 184. Therefore, as illustrated by FIGS. 5 through 9 as the slag cleaning system 100 is positioned into place for clearing slag, the support pivot arm 122 and the pivot actuation arm 124 rotate the ram support 140 about the first ram support mount 182 and the second ram support mount 184, such that the ram 130 and ram support 140 move from a position that is substantially parallel with the pivot support arm 122 and pivot actuation arm 124 to a position that is substantially perpendicular with the pivot support arm 122 and pivot actuation arm 124.

FIG. 10 illustrates an embodiment of the invention in which the ram 130 is moved into the extended ram position. In the illustrated embodiment, the ram 130 comprises a ram housing 132, an actuating ram 134, and a piercing ram 136, with a pierce head 138 operatively coupled to the piercing ram 136. As illustrated in FIGS. 10 and 21, the ram housing 132 has roller supports 190 that house one or more rollers 192, which in the illustrated embodiment comprise four rollers 192 in each roller support 190 for contacting the four edges of the actuating ram 134 as it is extended an retracted within the ram housing 132. In one embodiment, the actuating ram 134 is extended and retracted within the ram housing 132 using a ram actuating system comprising one or more actuators (not illustrated), such as hydraulic actuators. The one or more actuators may be located outside of or inside the ram 130, such as attached to the outer surface of the ram housing 132 or located within the ram housing 132 itself. In this embodiment the rollers 192 are not powered and act as a guides on the outside of the actuating ram 134 to facilitate the movement of the actuating ram 134 within the ram housing 132. In other embodiments of the invention, the ram actuating system may drive the rollers 192 through the use of a powered device, such as through the use of motors. In other embodiments of the invention, the actuating ram 134 may be moved with respect to the ram housing 132 through the use of a track system, rail system, or in some embodiments the ram housing 132 itself may be a hydraulic cylinder.

In the illustrated embodiment the ram 130 has a piercing ram 136 section coupled to the actuating ram 134 section, such that the piercing ram 136 is not retracted within the ram housing 132. In operation the piercing ram 136 has a piercing head 138, such that both the piercing ram 136 and the piercing head 138 are inserted, at least partially, into the opening of the slag door 210 and through the molten slag and solidified slag exiting the opening of the slag door 210. Consequently, some slag may solidify at least partially on the piercing ram 136 and/or piercing head 138. In the illustrated embodiment, the piercing ram 136 may not be retracted into the ram housing 136 in order to prevent slag from accumulating on or within the ram housing 136, rollers 192, and other components of the ram 130. In other embodiments of the invention the piercing ram 136 may be retractable into the ram housing 132 such that the solidified slag on the piercing ram 136 may be removed by the ram housing 132 or another device as the piercing ram 136 is retracted into the ram housing 132.

In some embodiments of the invention the piercing head 138 has a blade or a point that operates to clear the slag from the slag door by slicing, cutting, breaking apart, or otherwise disrupting the solidified slag using the piercing head 138 of the ram 130. In other embodiments of the invention, the ram 130 may have more or fewer sections (e.g., multiple actuating rams 134, a single section that acts as both the actuating ram 134 and piercing ram 136, or the like) that may or may not be retractable or moveable for operation and storage purposes.

In some embodiments of the invention the ram 130 may be configured with up to fifty-two (52) tons of force (or more or less), to provide ample force for clearing the slag from the opening of the slag door 210, clearing slag within the furnace 200, moving material within the furnace 200, or the like. As previously discussed, in order to counter the force of the ram 130 one or more anchor systems 160 may be used to operatively couple (e.g., removeably couple) the slag clearing system 100 (e.g., pivot arm 120, ram 130, ram support 140, or the like) to the furnace 210, furnace deck 230, other structural support attached to the furnace 210 or furnace deck 230 (e.g., support bar 220), or the like, during clearing of the slag.

FIGS. 11 through 15, 19, 20, and 21 illustrate an embodiment of the present invention in which the ram 130 is configured to move in the horizontal direction and the vertical direction in order to clear solidified slag from the opening of the slag door 210. In the illustrated embodiment, the ram support 140 may comprise a support outer housing 142 as illustrated in FIG. 19, and a support inner housing 144 as illustrated in FIG. 20. The support outer housing 142 and the support inner housing 144 may be operatively coupled to each other by inserting the first pivot pins 146 on the outer housing 142 into the support apertures 186 of the inner housing 144 that are configured to receive the first pivot pints 146. Consequently, the inner housing 144 may rotate vertically in an up or down direction with respect to the support outer housing 142 around the first pivot pins 146. Furthermore, the support inner housing 144 may be operatively coupled to the ram 130 through the ram housing 132. The support inner housing 144 may comprise second pivot pins 148, which are operatively coupled (e.g., inserted into) to ram housing apertures 188 (e.g., female fittings, counter bore holes, or the like), such that the ram 130 may be actuated in the horizontal direction with respect to the second pivot pins 148.

FIGS. 11 through 15, 19, 20, and 21 further illustrate that the support outer housing 142 is also operatively coupled to the support inner housing 144 by the vertical actuation device 154. In the illustrated embodiment the vertical actuation device 154 comprises two actuators, such as hydraulic actuators, that are secured on a first end to the support outer housing 142 and on a second end to the vertical actuator mounts 194 of the inner housing 144. Furthermore, the support inner housing 144 is operatively coupled to the ram housing 132 through the use of a horizontal actuation device 152. In the illustrated embodiment, the horizontal actuation device 152, is a single actuator, such as a hydraulic actuator, that is operatively coupled on a first end to a horizontal actuator mount 196 on the inner housing 144, and operatively coupled on a second end to a ram housing actuator mount 198. The vertical actuation device 154 and the horizontal actuation device 152 allow for actuation of the ram 130 in the horizontal and vertical directions in order to remove the solidified slag or solidifying slag from various locations throughout the opening of the slag door 210 depending on where the slag is solidifying.

In alternative embodiments of the invention, the described and illustrated vertical and horizontal movement of the ram 130 based on the outer support housing 142 and inner support housing 144 may be reversed, such that the inner support housing 144 may be moveable with respect to the outer support housing 142 in the horizontal direction, while the ram housing 132 may be moveable with respect to the inner support housing 144 in the vertical direction. In still other embodiments of the invention the ram 130 may be fixed within the inner housing, and thus, the inner support housing 144 may move with respect to the outer support housing 142 in both the vertical direction and horizontal direction. In still other embodiments of the invention, the ram 130 may be operatively coupled to the outer support housing 142, and thus may be moveable in the vertical and horizontal directions without the use of an inner support housing.

In some embodiments of the invention the slag clearing system 100, or the individual components thereof (e.g., pivot arm 110, ram 130, or the like) may be controlled by a human operators (e.g., workers) using controls (e.g., joystick, computer, keyboard, or the like). The present invention allows the human operators to operate the slag clearing system 100 from a safe distance away from the potentially dangerous environment around the area of the furnace, and specifically around the opening of the slag door 210 as slag is being removed from the furnace 200. For example, in some embodiments, the slag clearing system 100 may be operated by human operators from a booth or vestibule located near or adjacent the furnace 200.

Furthermore, in one embodiment of the invention, the human operator controls the slag clearing system 100 through a direct line of sight of the furnace 200 and slag clearing system 100. For example, the human operator views the slag exiting the opening in the slag door 210 and determines when removal of the solidified slag is required, and thus, maneuvers the slag clearing system 100 accordingly. In other embodiments of the invention, a camera may be operatively coupled to the slag clearing system 100, such as to the ram 130, ram support 140, and/or pivot arm 120, such that the human operator does not need to have a direct line of sight to the slag clearing system 100, the furnace 200, or slag door 210 of the furnace, in order to clear the solidified slag from the opening of the slag door 210. Consequently, in some embodiments of the invention the human operator may be in a location away from the furnace 200 and slag clearing system 100, and for example, may be in a location without visual access or may even be located off-site from the furnace.

In other embodiments of the invention, the slag clearing system 100, or individual components thereof may be controlled automatically by a computer and computer software that automatically actuates the pivot arm 120 and/or ram 130 to clear solidified slag from the slag door 210. In this embodiment, the operation of the slag clearing system 100 may be part of an automated process that automatically clears solidified slag from the opening of the slag door 210 during the operation of the furnace.

In still other embodiments of the invention, the pivot arm 120 and/or the ram 130 may have stops that prevent a human operator or automated computer system from moving the pivot arm 120 and/or the ram 130 to a location outside of the desired position. For example, limiting the positioning of the pivot arm 120 to the desired extended arm position or retracted arm position using stops prevents damaging the furnace, such as the furnace walls, or other components within the furnace bay. Furthermore, the stops may also limit the movement of the ram 130 in the vertical and horizontal directions, such that the ram 130 may be limited to moving within a predetermined opening of the slag door 210 in order to prevent the ram 130 from damaging the sides of the slag door 210 or the bricks around the sides of the slag door 210. The ram 130 may also be restricted from extending into an extended ram position within the furnace that would contact an inner wall within the furnace 200 and damaging the furnace wall or bricks within the furnace. Any damage to the slag door and/or furnace bricks may result in unscheduled shutdowns of the furnace 200 for repairs. The stops may comprise physical limits on the slag clearing system 100, such as physical stoppers on the ram support 140, or on the vertical ram actuation device 154 or the horizontal ram actuation device 152 (e.g., hydraulic cylinders). In other embodiments of the invention the stops may comprise physical limits or computer software limits on the hardware (e.g., joystick, or the like) and software used to actuate the slag clearing system 100 (e.g., pivot arm 120 and ram 130)

In still other embodiments of the invention the ram 130 may be able to extend not only through the opening of the slag door 210, but also extend all the way into the furnace to the wall opposing the opening in the slag door 210. In some scenarios it may be beneficial to utilize the slag clearing system 100 for performing tasks associated with breaking up solidified slag in areas within the furnace, or moving or breaking up other material located within the furnace that the ram 130 on the slag clearing system 100 may be able to reach. In still other embodiments of the invention the ram 130 may be outfitted with other devices for repairing or reviewing the furnace or components thereof. For example, a camera, probe, sample gathering device, or the like may be attached to the ram 130.

The embodiments of the invention described and illustrated herein, have been described with respect to the use of an arm that has a pivoting configuration, however, as previously discussed, the arm of the slag clearing system 100 may have different configurations, such as a multiple hinged arm that folds upon itself, an arm that is collapsible upon itself along a longitudinal axis running through the middle of the arm, or another configuration. It should be understood that attaching the ram 130 to the other types of retractable arms is contemplated by this invention. Furthermore, it should be understood that different types of rams may be utilized with the pivot arm 120 disclosed herein to accomplish the results of clearing slag from the opening of the slag door 210. Moreover, specific types of vertical and horizontal ram actuating devices are described herein, and it should be understood that alternate embodiments of the ram, ram support, vertical and horizontal ram actuation devices, and ram actuating devices, as well as the configurations for operatively coupling these components are contemplated by this application.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. An apparatus comprising:

a pivot support comprising a pivot support tower, a pivot support shaft operatively coupled to the pivot support tower, and a support actuator operatively coupled to the pivot support shaft;

a pivot arm operatively coupled to the pivot support shaft of the pivot support;

a ram support operatively coupled to the pivot arm;

a ram operatively coupled to the ram support;

wherein the support actuator rotates the support shaft to move the pivot arm from a pivot arm retracted position to a pivot arm extended position; and wherein the ram is configured to remove solidified slag from a slag door opening.

2. The apparatus of claim 1, wherein the ram support comprises:

a vertical ram actuation device.

3. The apparatus of claim 2, wherein the vertical ram actuation device comprises:

one or more hydraulic actuators operatively coupled to the ram support and the ram;

at least one first ram pin operatively coupled to the ram support and the ram; and wherein the hydraulic actuators rotate the ram in the vertical direction around the at least one first ram pin.

4. The apparatus of claim 1, wherein the ram support comprises:

a horizontal ram actuation device.

5. The apparatus of claim 4, wherein the horizontal ram actuation device comprises:

one or more hydraulic actuators operatively coupled to the ram support and the ram;

at least one second ram pin operatively coupled to the ram support and the ram; and wherein the hydraulic actuators rotate the ram in the horizontal direction around the at least one second ram pin.

6. The apparatus of claim 1, wherein the pivot arm comprises:

a first pivot arm operatively coupled at a first end to the pivot support and at a second end to the ram support at a first ram support mount;

a second pivot arm operatively coupled at a first end to the pivot support and at a second end to the ram support at a second ram support mount; and wherein as the first pivot arm and the second pivot arm rotate, the ram support rotates with respect to the first pivot arm and the second pivot arm at the first ram support mount and the second ram support mount.

7. The apparatus of claim 1, wherein the ram comprises:

an extending ram actuation device; and wherein the extending ram actuation device actuates the ram from a retracted position to an extended position.

8. The apparatus of claim 1, wherein the pivot support further comprises:

a pivot support base operatively coupled to the pivot support tower.

9. The apparatus of claim 1, further comprising:

an anchor system operatively coupled to the pivot arm or the ram support; and wherein the anchor system is operatively coupled for attachment or detachment to a furnace support.

10. The apparatus of claim 1, wherein the pivot support is operatively coupled to a furnace deck, and wherein the furnace deck is located adjacent to a furnace.

11. The apparatus of claim 1, wherein the ram comprises a pierce tip, and wherein the pierce tip is configured to pierce solidified slag through the slag door opening of a furnace.

12. An apparatus comprising:

an arm base support;

an arm operatively coupled to the arm base support;

a ram support operatively coupled to the arm, wherein the ram support comprises a vertical ram actuation device and a horizontal ram actuation device;

a ram operatively coupled to the ram support; and wherein the ram is configured to extend and retract to remove solidified slag from a slag door opening and actuate in a vertical direction using the vertical ram actuation device and in a horizontal direction using the horizontal ram actuation device to removed solidified slag from areas within the slag door opening.

13. A method comprising:

positioning a pivot arm into an extended arm position from a retracted arm position, wherein the pivot arm is operatively coupled to a pivot support shaft of a pivot support, wherein the pivot support comprises a pivot support tower, the pivot support shaft operatively coupled to the pivot support tower, and a support actuator operatively coupled to the pivot support shaft, and wherein the support actuator rotates the support shaft to move the pivot arm from the retracted position to the extended position;

positioning a ram into an extended ram position, wherein the ram is operatively coupled to the pivot arm through a ram support; and clearing solidified slag from a slag door opening.

14. The method of claim 13, further comprising:

actuating the ram in a vertical direction, wherein the ram is actuated using a vertical ram actuation device.

15. The method of claim 14, wherein the vertical ram actuation device comprises:

one or more hydraulic actuators operatively coupled to the ram support and the ram;

at least one first ram pin operatively coupled to the ram support and the ram; and wherein actuating the ram in a vertical direction comprises using the one or more hydraulic actuators to rotate the ram in the vertical direction around the at least one first ram pin.

16. The method of claim 13, further comprising:

actuating the ram in the horizontal direction, wherein the ram is actuated using a horizontal ram actuation device.

17. The method of claim 16, wherein the horizontal ram actuation device comprises:

one or more hydraulic actuators operatively coupled to the ram support and the ram;

at least one second ram pin operatively coupled to the ram support and the ram; and wherein actuating the ram in the horizontal direction comprises using the one or more hydraulic actuators to rotate the ram in the horizontal direction around the at least one second ram pin.

18. The method of claim 13, wherein the pivot arm comprises:

a first pivot arm operatively coupled at a first end to the pivot support and at a second end to the ram support at a first ram support mount;

a second pivot arm operatively coupled at a first end to the pivot support and at a second end to the ram support at a second ram support mount; and wherein positioning the pivot arm in the extended position comprises rotating the first pivot arm and the second pivot arm, such that as the first pivot arm and the second pivot arm rotate, the ram support rotates with respect to the first pivot arm and the second pivot arm at the first ram support mount and the second ram support mount.

19. The method of claim 13, wherein the ram comprises:

an extending ram actuation device; and wherein positioning the ram into an extended position comprises actuating the ram from a retracted position to an extended position using the extending ram actuation device.

20. The method of claim 13, wherein the pivot support further comprises:

a pivot support base operatively coupled to the pivot support tower.

21. The method of claim 13, further comprising:

operatively coupling the pivot arm to a furnace support using an anchor system, wherein the anchor system is operatively coupled for attachment or detachment to the furnace support.

22. The method of claim 13, wherein the pivot support is operatively coupled to a furnace deck, and wherein the furnace deck is located adjacent a furnace.

23. The method of claim 13, wherein the ram comprises a pierce tip, and wherein clearing solidified slag from a slag door opening comprises piercing the solidified slag using the pierce tip.

24. An method comprising:

positioning an arm into an extended arm position from a retracted arm position, wherein the arm is operatively coupled to an arm base support;

positioning a ram into an extended ram position within a slag door opening, wherein the ram is operatively coupled to the arm through a ram support comprising a vertical ram actuation device and a horizontal ram actuation device; and clearing solidified slag from the slag door opening by actuating the ram in a vertical direction using the vertical ram actuation device and in a horizontal direction using the horizontal ram actuation device.

25. An apparatus comprising:

an arm base support;

an arm operatively coupled to the arm base support;

a ram support operatively coupled to the arm;

a ram operatively coupled to the ram support; and an anchor system operatively coupled to the arm or the ram support;

wherein the anchor system is operatively coupled for attachment or detachment to a furnace support; and wherein the ram is configured to remove solidified slag from a slag door opening.

26. A method comprising:

positioning an arm into an extended arm position from a retracted arm position, wherein the arm is operatively coupled to an arm base support;

operatively coupling the arm or a ram support to a furnace support using an anchor system, wherein the anchor system is operatively coupled for attachment or detachment to the furnace support;

positioning a ram into an extended ram position within a slag door opening, wherein the ram is operatively coupled to the arm through the ram support; and clearing solidified slag from the slag door opening.

* * * * *